US009220354B2

(12) United States Patent
Nguyen et al.

(10) Patent No.: US 9,220,354 B2
(45) Date of Patent: Dec. 29, 2015

(54) MERCHANDISER WITH AIRFLOW DIVIDER

(71) Applicant: Hussmann Corporation, Bridgeton, MO (US)

(72) Inventors: Ken Nguyen, St. Louis, MO (US); Timothy D. Anderson, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 316 days.

(21) Appl. No.: 13/963,180

(22) Filed: Aug. 9, 2013

(65) Prior Publication Data

US 2013/0319030 A1 Dec. 5, 2013

Related U.S. Application Data

(63) Continuation-in-part of application No. 13/768,230, filed on Feb. 15, 2013.

(60) Provisional application No. 61/600,349, filed on Feb. 17, 2012.

(51) Int. Cl.
*A47F 3/04* (2006.01)
*F25D 17/06* (2006.01)

(52) U.S. Cl.
CPC ..... *A47F 3/0447* (2013.01); *F25D 17/067* (2013.01); *F25D 2317/063* (2013.01)

(58) Field of Classification Search
CPC .... A47F 3/0443; A47F 3/0477; A47F 3/0439
USPC ..... 62/89, 251, 256
See application file for complete search history.

(56) References Cited

U.S. PATENT DOCUMENTS 3,009,333 A 11/1961 Rainwater
3,289,432 A 12/1966 Brennan et al.

(Continued)

FOREIGN PATENT DOCUMENTS

DE 4305476 8/1993
DE 102006015992 10/2007

(Continued)

OTHER PUBLICATIONS

EP13155659.9 Extended Search Report and Written opinion dated May 15, 2013 (6 pages).

(Continued)

*Primary Examiner* — Melvin Jones
(74) *Attorney, Agent, or Firm* — Michael Best & Friedrich LLP

(57) ABSTRACT

A refrigerated merchandiser includes a case defining a product display area and having a base, a lower flue, a first air passageway, and a second air passageway. The first air passageway and second air passageway are in fluid communication with the lower flue and with the product display area. A fan plenum has an outlet defining a first plane. A second plane is defined perpendicular to the first plane and passing through the center of a fan aperture. The fan plenum further includes an airflow divider with a first wall member and a second wall member positioned to direct a first portion of the airflow to the first air passageway and a second portion of the airflow to the second air passageway. The space between the first wall member and the second wall member defines an area, the greater portion of which is to one side of the second plane.

20 Claims, 17 Drawing Sheets

(56) References Cited

U.S. PATENT DOCUMENTS

| | | | | | |
|---|---|---|---|---|---|
| 3,496,732 | A | * | 2/1970 | Hermanson | A47F 3/0447 62/126 |
| 3,850,003 | A | * | 11/1974 | Beckwith | F25D 21/125 62/256 |
| 4,026,121 | A | * | 5/1977 | Aokage | F25D 21/125 62/151 |
| 4,326,385 | A | * | 4/1982 | Ibrahim | F25D 21/125 62/256 |
| 4,361,012 | A | | 11/1982 | Ibrahim | |
| 4,389,852 | A | | 6/1983 | Abraham | |
| 4,478,047 | A | | 10/1984 | Ibrahim | |
| 5,475,988 | A | * | 12/1995 | McGovern | F25D 21/14 62/256 |
| 5,923,496 | A | | 7/1999 | Perona | |
| 6,694,765 | B1 | | 2/2004 | Waldschmidt et al. | |
| 7,062,932 | B2 | | 6/2006 | Downs | |
| 7,162,882 | B2 | | 1/2007 | Alahyari et al. | |
| 2003/0188847 | A1 | | 10/2003 | Lai et al. | |
| 2007/0012059 | A1 | | 1/2007 | Roche et al. | |
| 2009/0215380 | A1 | | 8/2009 | Lin | |
| 2011/0259031 | A1 | | 10/2011 | Anderson et al. | |
| 2013/0019621 | A1 | | 1/2013 | Wood et al. | |

FOREIGN PATENT DOCUMENTS

| | | |
|---|---|---|
| FR | 2465446 | 3/1981 |
| JP | 62201035 | 9/1987 |
| WO | 2011074994 | 6/2011 |

OTHER PUBLICATIONS

Co-pending U.S. Appl. No. 13/768,230, filed Feb. 15, 2013.
Patent Examination Report No. 1 from IP Australia for Application No. 2014202348 dated May 5, 2015 (2 pages).

* cited by examiner

MERCHANDISER WITH AIRFLOW DIVIDER

BACKGROUND

The present invention relates to a merchandiser including a fan apparatus that discharges an airflow into two separate airflow paths to generate a primary air curtain and a secondary air curtain.

Generally, air is directed through one or more air passageways in a merchandiser to provide cooling to the product display area of the merchandiser. Often, a primary air curtain is provided to cool the product display area, and one or more secondary air curtains can be provided to buffer the primary air curtain and the product display area from ambient air surrounding the merchandiser. Conventional merchandisers typically utilize one fan assembly to generate a first airflow through the merchandiser (e.g., for the primary air curtain) and another, separate fan assembly to generate a second airflow through the merchandiser (e.g., for the secondary air curtain).

SUMMARY

The invention provides, among other things, a refrigerated merchandiser including a fan assembly that has an airflow divider to direct air discharged from a single fan into separate passageways to generate primary and secondary air curtains.

In one embodiment, a refrigerated merchandiser includes a case defining a product display area and having a base, a lower flue, a first air passageway, and a second air passageway. The first air passageway and second air passageway are in fluid communication with the lower flue and with the product display area. The refrigerated merchandiser also includes an evaporator positioned in the first air passageway and a fan assembly positioned in the base in fluid communication with the lower flue to generate an airflow. A fan plenum into which the fan assembly is disposed includes an airflow divider to direct a first portion of the airflow to the first air passageway and to direct a second portion of the airflow to the second air passageway. The proportion of air between the first portion and the second portion is a function of the position and geometry of the airflow divider.

In one embodiment, a refrigerated merchandiser includes a case defining a product display area, a first air passageway, and a second air passageway, in which the first air passageway and second air passageway are in fluid communication with the product display area. A fan has a plurality of fan blades and is operable to generate an airflow. An airflow divider is positioned adjacent the plurality of fan blades to direct a first portion of the airflow to the first air passageway and to direct a second portion of the airflow to the second air passageway. The proportion of air between the first portion and the second portion is a function of the position and geometry of the airflow divider.

In one embodiment of a fan plenum for a refrigerated merchandiser, in which the refrigerated merchandiser includes a case defining a product display area and a lower flue, a first air passageway, and a second air passageway, and in which the first air passageway and second air passageway are in fluid communication with the lower flue and with the product display area, the fan plenum includes a top wall including a fan aperture for receiving a fan having a plurality of fan blades. The fan plenum further includes a side wall and a plenum base. An airflow divider partitions the fan plenum into a first duct and a second duct. The first duct is fluidly couplable with the first air passageway and the second duct is fluidly couplable with the second air passageway.

In one embodiment, a refrigerated merchandiser includes a case defining a product display area and having a base, a lower flue, a first air passageway, and a second air passageway. The first air passageway and second air passageway are in fluid communication with the lower flue and with the product display area. An evaporator is positioned in the first air passageway and a fan assembly is positioned in the base in fluid communication with the lower flue to generate an airflow. A fan plenum into which the fan assembly is disposed includes a wall having a first portion with a first face, a second portion with a second face, an intermediate portion connecting the first portion to the second portion and having an intermediate face, and an airflow divider to direct a first portion of the airflow to the first air passageway and to direct a second portion of the airflow to the second air passageway. The airflow divider includes a first wall member extending to the first face and a second wall member extending to the intermediate face. The proportion of air between the first portion and the second portion is a function of the position and geometry of the airflow divider.

In one embodiment, a refrigerated merchandiser includes a case defining a product display area and having a base, a lower flue, a first air passageway, and a second air passageway. The first air passageway and second air passageway are in fluid communication with the lower flue and with the product display area. An evaporator is positioned in the first air passageway and a fan assembly is positioned in the base in fluid communication with the lower flue to generate an airflow. A fan plenum with a fan aperture, the aperture having a center, into which the fan assembly is disposed has an outlet defining a first plane. A second plane is defined perpendicular to the first plane and passing through the center of the fan aperture. The fan plenum further includes an airflow divider with a first wall member and a second wall member positioned to direct a first portion of the airflow through the outlet to the first air passageway and to direct a second portion of the airflow through the outlet to the second air passageway. The space between the first wall member and the second wall member defines an area, the greater portion of which is to one side of the second plane.

In one embodiment, a fan plenum for a refrigerated merchandiser, in which the refrigerated merchandiser includes a case defining a product display area and having a lower flue, a first air passageway, and a second air passageway, with the first air passageway and second air passageway in fluid communication with the lower flue and with the product display area, includes a top wall having a fan aperture for receiving a fan with a plurality of fan blades. The fan aperture has a center. The fan plenum has an outlet defining a first plane. A second plane is defined perpendicular to the first plane and passing through the center of the fan aperture. An airflow divider with a first wall member and a second wall member is positioned to direct a first portion of the airflow through the outlet to the first air passageway and to direct a second portion of the airflow through the outlet to the second air passageway. The space between the first wall member and the second wall member defines an area, the greater portion of which is to one side of the second plane.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. As used herein and in the appended claims, the terms "upper", "lower", "top", "bottom", "front", "back", and other directional terms are not intended to require any particular orientation, but are instead used for purposes of description only.

Figure 1:
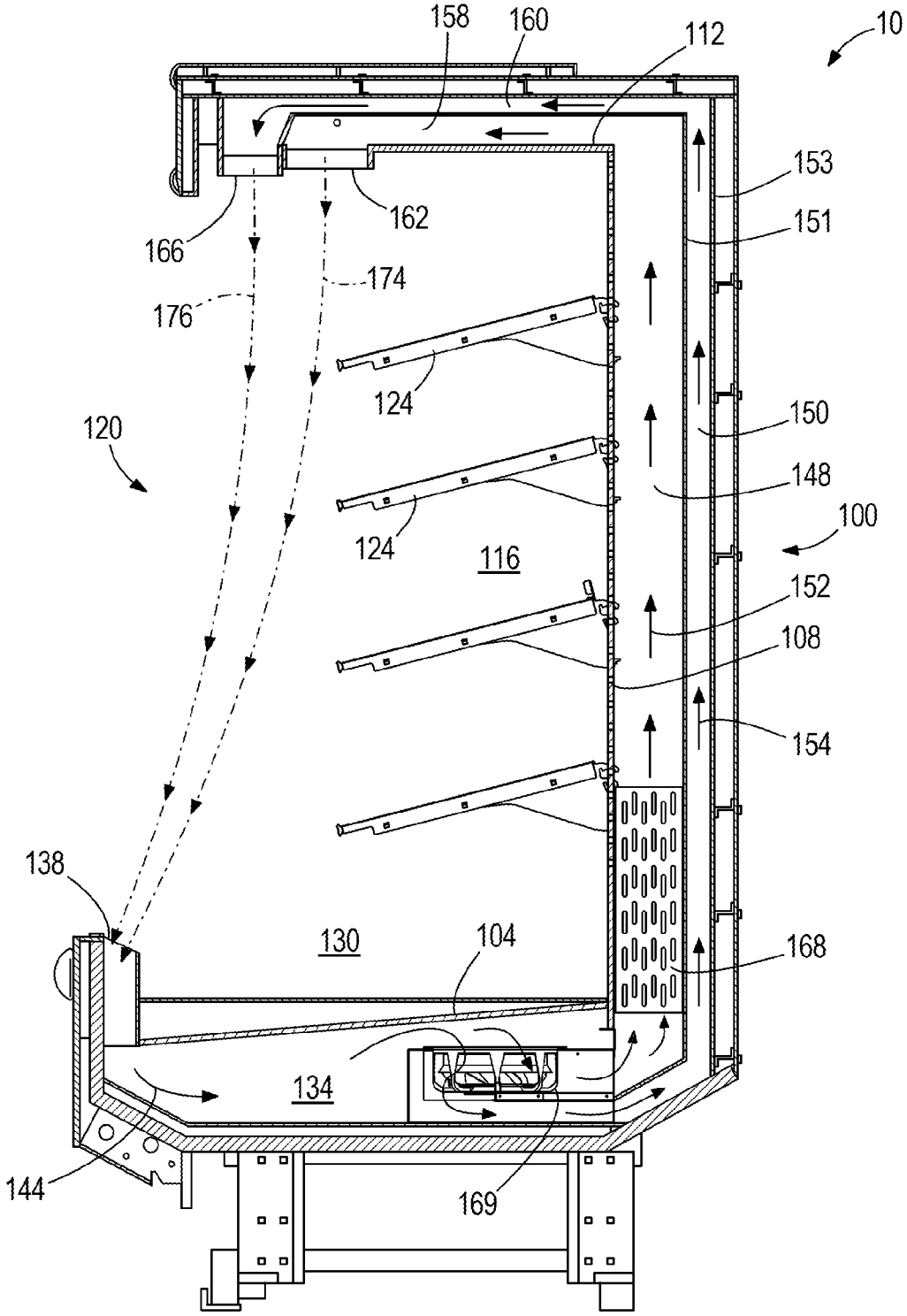
FIG. 1 is a section view of a merchandiser including a product display area, a first air passageway, a second air passageway, and a fan apparatus embodying the invention.

FIG. 1 shows a refrigerated merchandiser 10 that supports product for access by consumers. The merchandiser 10 includes a case 100 that has a base 104, a rear wall 108, and a canopy or case top 112. The area partially enclosed by the base 104, the rear wall 108, and the canopy 112 defines a product display area 116. As illustrated, the product display area 116 is accessible by customers through an opening 120 adjacent the front of the case 100. Shelves 124 are coupled to the rear wall 108 and extend forward toward the opening 120 adjacent the front of the merchandiser to support food product that is accessible by a consumer through the opening 120. Although the merchandiser illustrated and described with regard to FIGS. 1-8 is an open-front vertically-oriented merchandiser, the merchandiser can be any type of merchandiser that supports product (e.g., a horizontal merchandiser, an enclosed merchandiser with doors, etc.) All such merchandisers are considered herein.

The base 104 defines a lower portion 130 of the product display area 116 and can support a portion of the food product in the case 100. The base 104 further defines a lower flue 134 and includes an inlet 138 located adjacent the opening 120. As illustrated, the lower flue 134 is in fluid communication with the inlet 138 and conducts an airflow 144 substantially horizontally through the base 104 from the inlet 138. The inlet 138 is positioned to receive surrounding air in a substantially vertical direction to direct it into the lower flue 134.

With continued reference to FIG. 1, the case 100 includes a primary rear flue 148 and a secondary rear flue 150 extending upward from the base 104 and in fluid communication with the lower flue 134. The primary rear flue 148 is defined by the rear wall 108 and an intermediate wall 151 spaced apart from the rear wall 108 and directs a first airflow 152 generally vertically through the case 100. The secondary rear flue 150 is defined by the intermediate wall 151 and an exterior wall 153 of the case 100 and directs a secondary airflow 154 generally vertically through the case 100. In some constructions, the rear wall 108 can include apertures (not shown) that fluidly couple the primary rear flue 148 with the product display area 116 to permit at least some of the primary airflow 152 to enter the product display area 116.

The canopy 112 defines a primary upper flue 158 and a secondary upper flue 160. The primary upper flue 158 is in fluid communication with the primary rear flue 148, and the secondary upper flue 160 is in fluid communication with the secondary rear flue 150. The primary upper flue 158 directs the primary airflow 152 substantially horizontally through the canopy 112 toward a primary outlet 162. The secondary upper flue 160 directs the secondary airflow 154 substantially horizontally through the canopy 112 toward a secondary outlet 166.

The lower flue 134, the primary rear flue 148, and the primary upper flue 158 are fluidly coupled to each other to define a primary air passageway that directs a portion of the airflow 144 (i.e., the primary airflow 152) from the inlet 138 to the primary outlet 162. The lower flue 134, the secondary rear flue 150, and the secondary upper flue 160 are fluidly coupled to each other to define a secondary air passageway that directs the remaining portion of the airflow 144 (i.e., the secondary airflow 154) from the inlet 138 to the secondary outlet 166.

FIG. 1 shows that the merchandiser 10 also includes a heat exchanger or evaporator 168 that is positioned in the primary air passageway, and a fan apparatus 169 that is positioned in the base 104 and in fluid communication with the lower flue 134. As will be understood and appreciated by one of ordinary skill in the art, the heat exchanger 168 transfers heat from the primary airflow 152 to refrigerant flowing through the heat exchanger 168. As oriented, the primary airflow 152 passes substantially vertically through the heat exchanger 168. The secondary airflow 154 within the secondary rear flue 150 is defined as non-refrigerated "bypass" airflow and is not in heat exchange relationship with refrigerant flowing through the heat exchanger 168.

The primary airflow 152 that is discharged from the primary outlet 162 forms a primary air curtain 174 that is directed generally downward across the opening 120 to cool the food product within a desired or standard temperature range (e.g., 32 to 41 degrees Fahrenheit). Generally, the inlet 138 receives at least some air from the primary air curtain 174. The secondary airflow 154 that is discharged from the secondary outlet 164 forms a secondary air curtain 176 (e.g., refrigerated or non-refrigerated) that is directed generally downward across the opening 120 to buffer the primary air curtain 174 to minimize infiltration of ambient air into the product display area 116.

With reference to FIGS. 1-5, the fan apparatus 169 includes a fan assembly 170 and a plenum 172 that generates and divides the airflow 144 into the primary airflow 152 and the secondary airflow 154. As illustrated, the fan assembly 170 and the plenum 172 form a modular assembly. In some constructions, the fan assembly 170 and the plenum 172 can extend the length of the merchandiser 10.

FIGS. 2-5 show the fan assembly 170 and the plenum 172. The fan assembly 170 has a fan 200 (e.g., an axial flow or similarly constructed fan) with an inlet 204, an outlet 208, and a hub 212 that is powered by a motor (not shown). The hub 212 supports a plurality of fan blades 216, and a shroud 220 encircles and is fixed to the fan blades 216. As illustrated, the shroud 220 rotates with the blades 216 during operation of the fan 200. Support arms 224 form a basket that surrounds the shroud 220. Each support arm 224 adjoins a flange 230 that couples the fan assembly 170 to the plenum 172.

Figure 2:
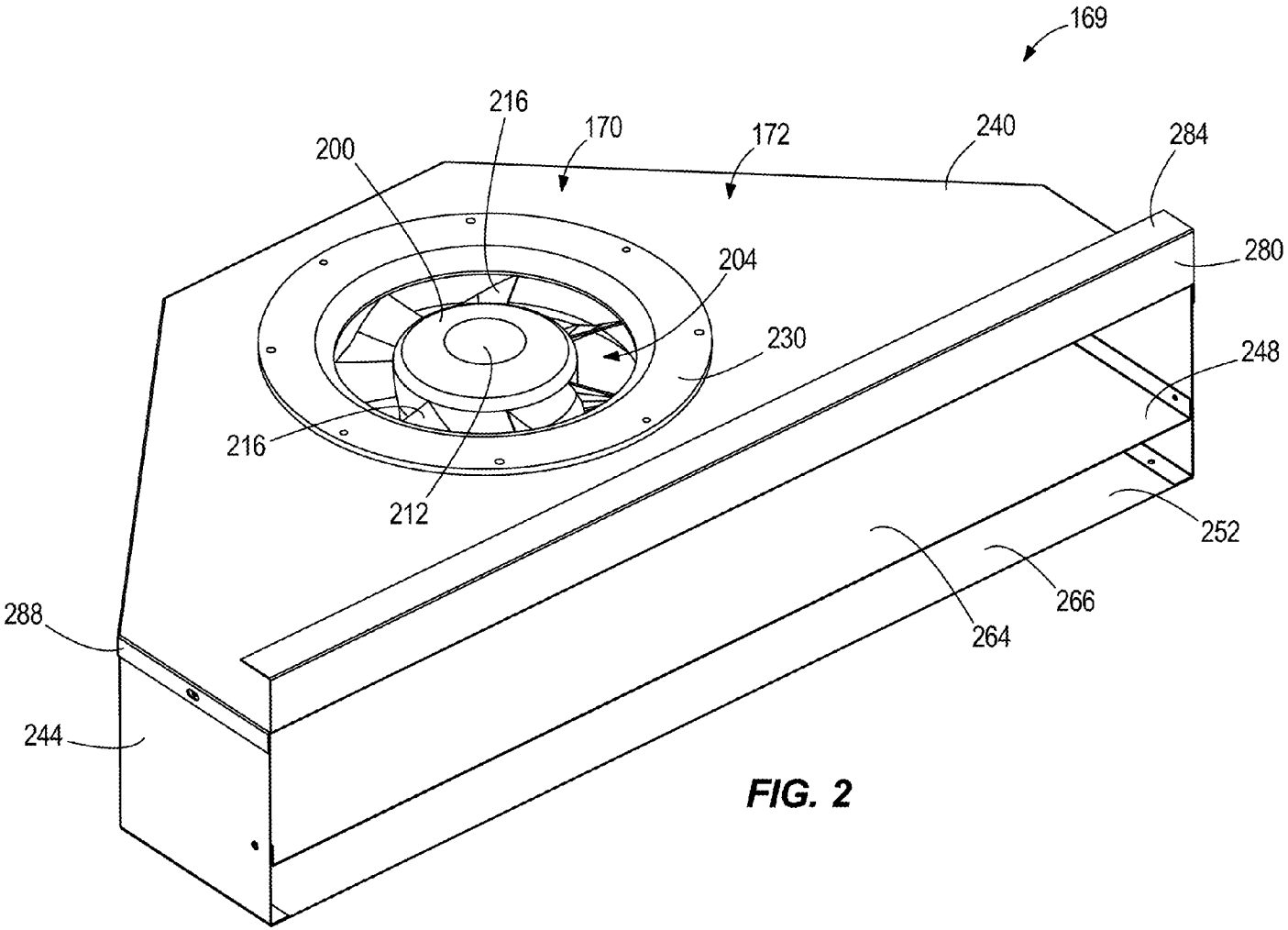
FIG. 2 is a perspective view of the fan apparatus including a fan assembly and a plenum of FIG. 1.
Figure 4:
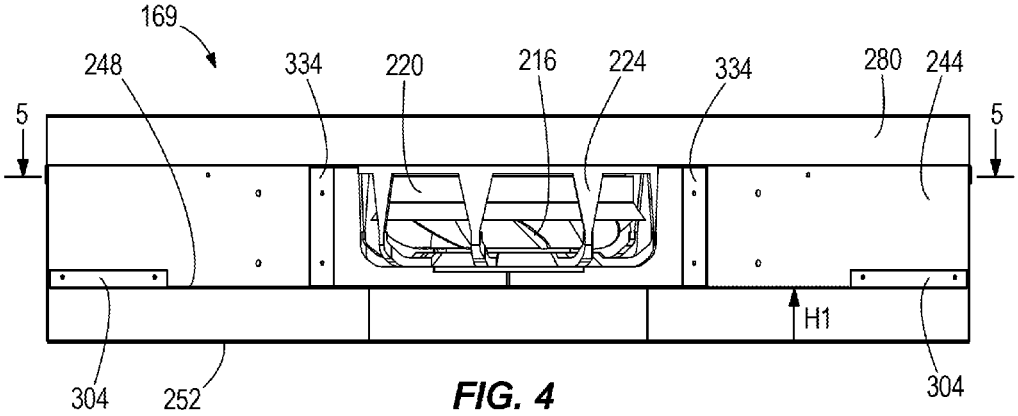
FIG. 4 is a front view of the fan apparatus of FIG. 2.
Figure 5:
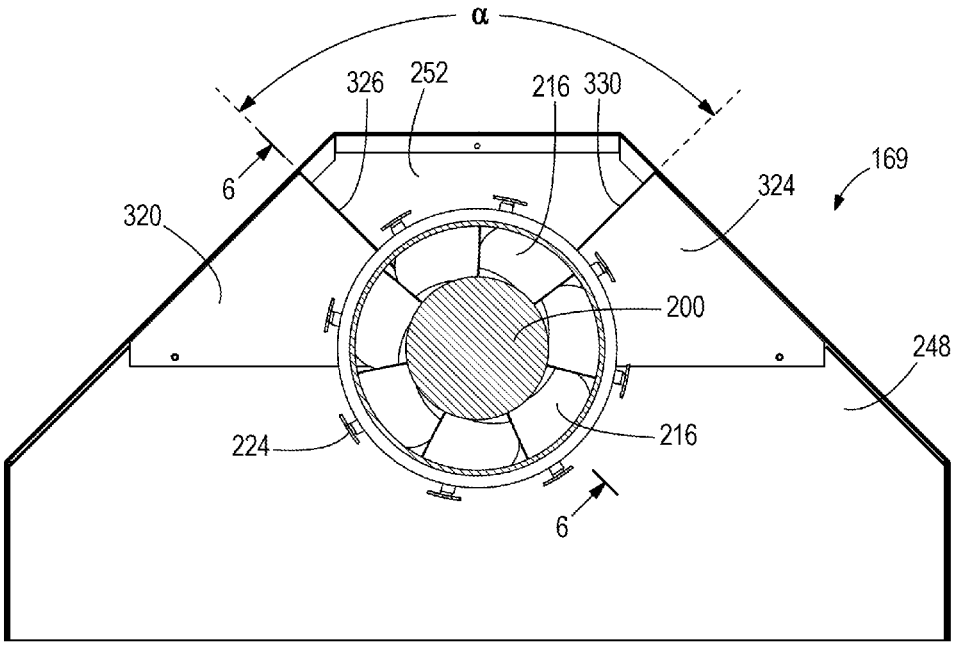
FIG. 5 is a section view of the fan apparatus of FIG. 4 taken along line 5-5.

With reference to FIGS. 2, 4, and 5, the plenum 172 includes a top wall 240, a surrounding multi-sectioned side wall 244, a primary duct base 248, a secondary duct base 252, and a divider 260 that cooperate to partition the plenum into a primary duct 264 and a secondary duct 266 (see FIG. 2). The plenum 172 can be formed from any suitable material (e.g., sheet metal such as galvanized steel, aluminum, or stainless steel, plastic, etc.).

Figure 3:
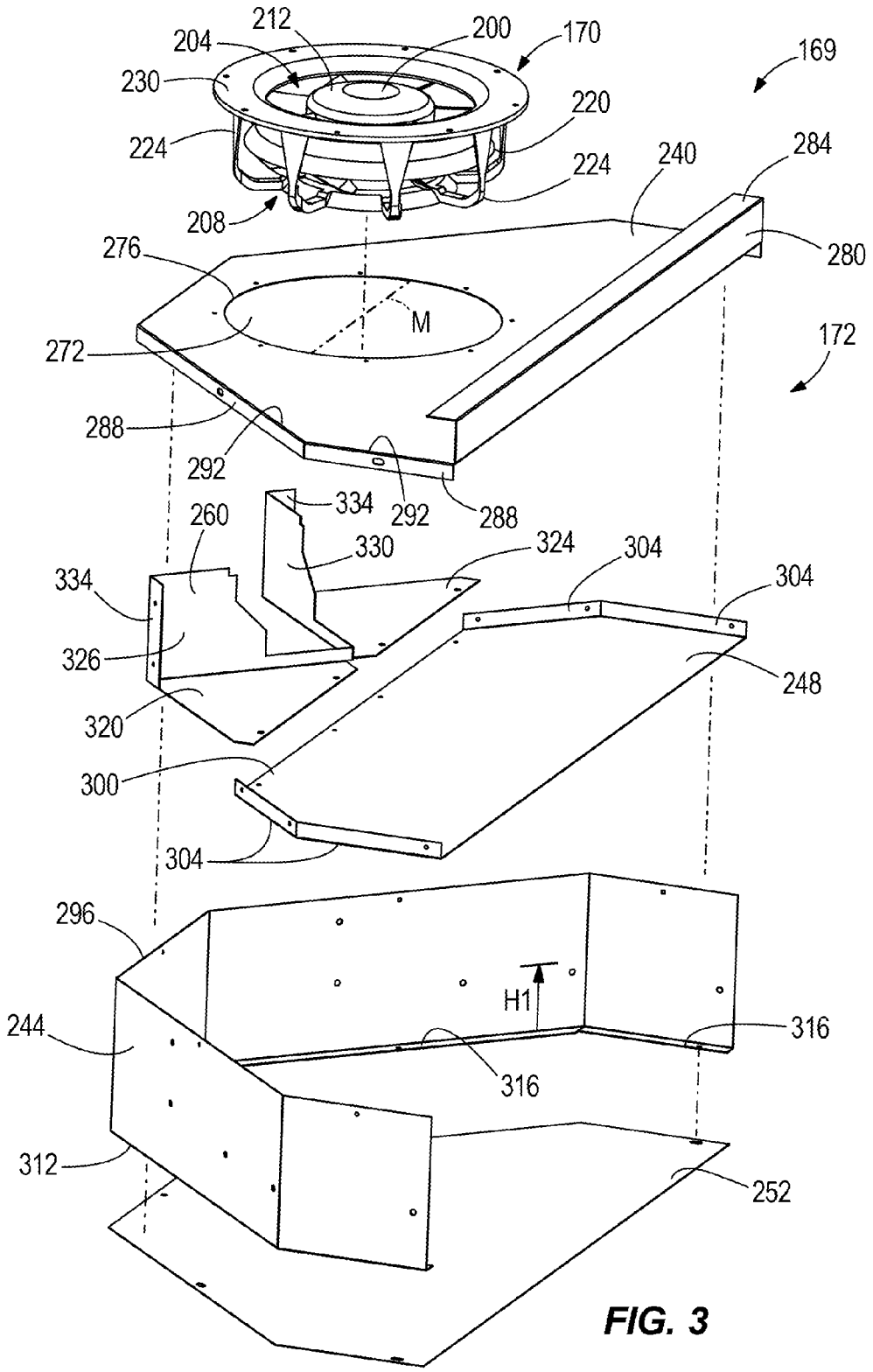
FIG. 3 is an exploded perspective view of the fan apparatus of FIG. 2.

With reference to FIG. 3, the top wall 240 includes a fan aperture 272 with a centerline M and a perimeter 276 to which the fan assembly 170 is secured (e.g., using conventional mounting hardware) via the flange 230. A rim 280 extends upward from and across an edge of the top wall 240 and includes an inward projecting edge 284. The top wall 240 spans the entirety of the area partially enclosed by the side wall 244. As illustrated, the top wall 240 includes tabs 288 at each edge 292 that secure the top wall 240 to the top edge 296 of the side wall 244.

The primary duct base 248 is disposed below and spaced from the top wall 240 to accommodate the fan assembly 170. The primary duct base 248 spans an area from the front rim 280 of the top wall 240 rearward to an edge 300 that is substantially coincident with the centerline M of the fan aperture 272. The primary duct base 248 is positioned substantially parallel to the top wall 240 and includes tabs 304 that removably secure the primary duct base 248 to the side wall 244 at an adjustable intermediate height H1 above a bottom edge 312 of the side wall 244.

The secondary duct base 252, which is located below the primary duct base 248, spans the entirety of the area partially enclosed by the side wall 244. The secondary duct base 252 is coupled to a plurality of bottom tabs 316 extending from the bottom edge 312 of the side wall 244.

With continued reference to FIG. 3, the divider 260 includes a first base member 320 and a second base member 324 that support a first wall member 326 and a second wall member 330, respectively. The first and second base members 320, 324 are coupled to the edge 300 of the primary duct base 248 and are positioned substantially flush with the primary duct base 248 when assembled onto the primary duct base 248. The first and second wall members 326, 330 each have tabs 334 that secure the divider 260 to the side wall 244. The first and second wall members 326, 330 operably separate the primary duct 264 from the secondary duct 266 and are, in profile, shaped to conform to the components of the fan assembly 170, as will be further described in detailed below. Referring to FIG. 5, the divider wall members 326, 330 are angled apart from each other at an angle α. In the illustrated embodiment, the angle α is approximately 90°. In other constructions, the angle α can range from approximately 45° to approximately 180°.

Figure 6:
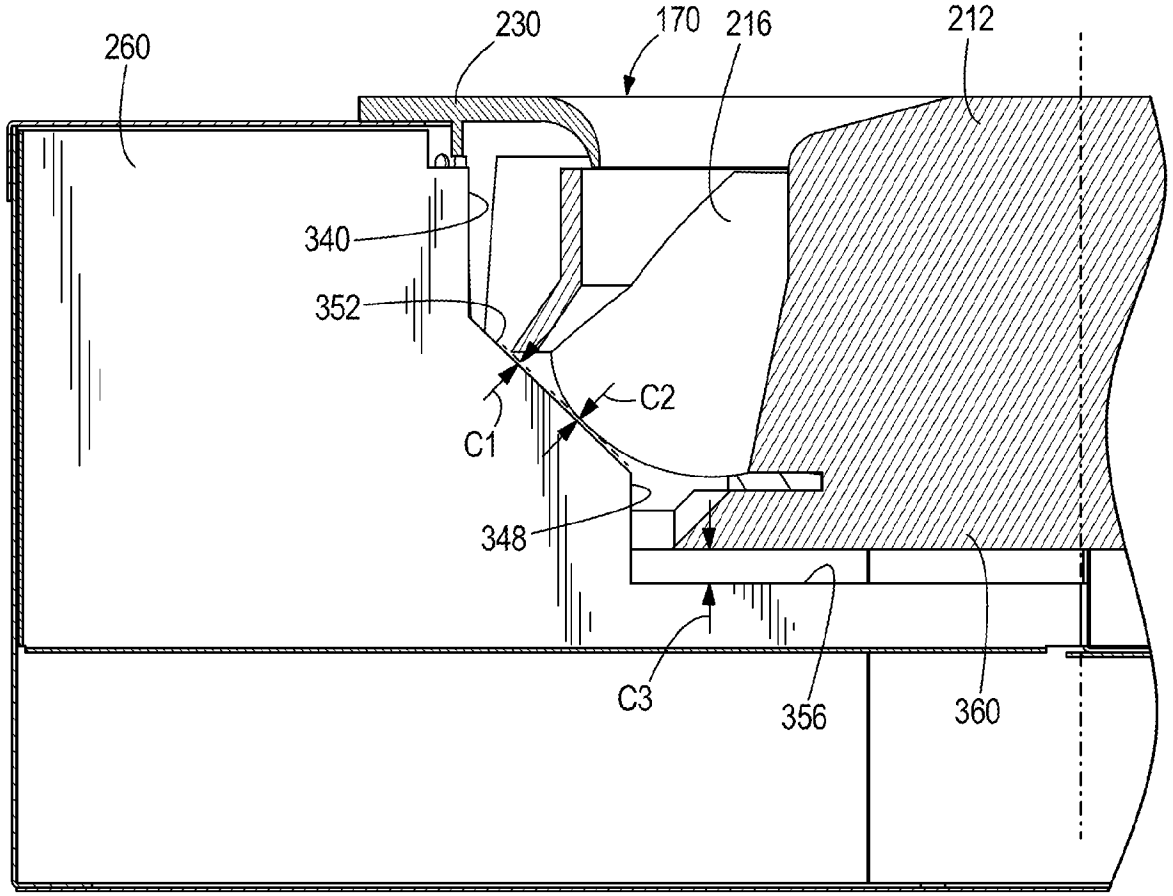
FIG. 6 is a section view of a portion of the fan apparatus of FIG. 5 taken along line 6-6.

FIG. 6 shows the structural relationship between the fan assembly 170 and the first divider wall 326. As illustrated, the divider wall 326 includes a first vertical edge 340 that is interconnected with a second vertical edge 348 via an angled edge 352, and a bottom edge 356 extending substantially horizontal from the second vertical edge 348. The fan assembly 170 is positioned so that a clearance C1 exists between the shroud 220 and the angled edge 352, and a clearance C2 exists between the tip of the fan blade 216 and the angled edge 352. To further facilitate fluid separation between the primary duct 264 and the secondary duct 266, the bottom edge 356 is positioned so that a clearance C3 exists between a bottom portion 360 of the hub 212 and the bottom edge 356. As illustrated, the clearance C1 is approximately 2 millimeters, the clearance C2 is approximately 2 millimeters, and the clearance C3 is approximately 9 millimeters, although other distances for the clearances C1, C2, C3 are also considered herein. For example, the clearance C1 can be between about 1 millimeter and about 18 millimeters, the clearance C2 can be between about 1 millimeter and about 13 millimeters, and the clearance C3 can be between about 3 millimeters and 25 millimeters.

Figure 8:
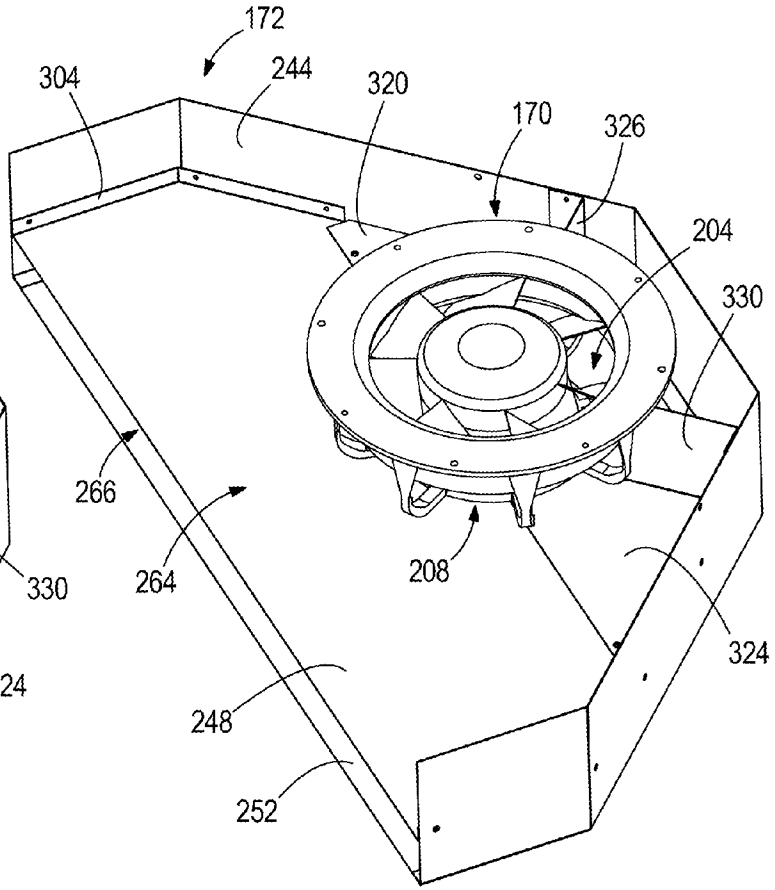
FIG. 8 is a perspective view of a portion of the fan assembly and the plenum of FIG. 2.
Figure 7:
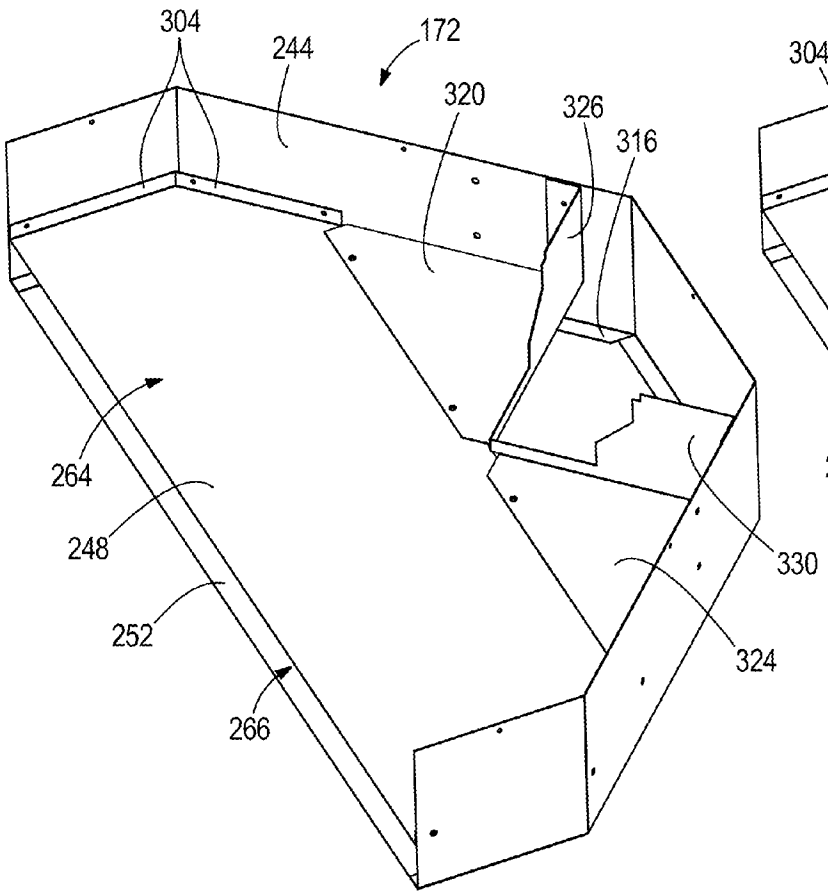
FIG. 7 is a perspective view of a portion of the plenum of FIG. 2.

Referring to FIGS. 7 and 8, the primary duct 264 generally defines a volume between the top wall 240 (not illustrated in FIGS. 7 and 8 for clarity), the primary duct base 248, the side wall 244, and the first and second divider walls 326, 330 that is in fluid communication with the fan outlet 208. The secondary duct 266 generally defines a volume between the primary duct base 248, the secondary duct base 252, the side wall 244, and the first and second divider walls 326, 330 that also is in fluid communication with the fan outlet 208.

In some constructions, two separate fan assemblies 170 can be used within a single plenum 172. In these constructions, the discharged airflow of each fan 200 is separated by a respective divider 260 into the primary and secondary ducts 264, 266. Also, while the divider 260 is illustrated as being integrated into the plenum 172, the divider 260 can instead be integrated into the fan assembly 170. In yet another construction, the fan assembly 170 and plenum 172 can be positioned at the rear of the case 100 or at the top of the case 100 (with modifications made as necessary to the flues 148, 150, 158, 160 and the heat exchanger 190).

FIGS. 9-16 show another fan apparatus 469 for use with the merchandiser 10. Except as described below, the fan apparatus 469 is the same as the fan apparatus 169 and like elements are given the same reference numerals.

Figure 9:
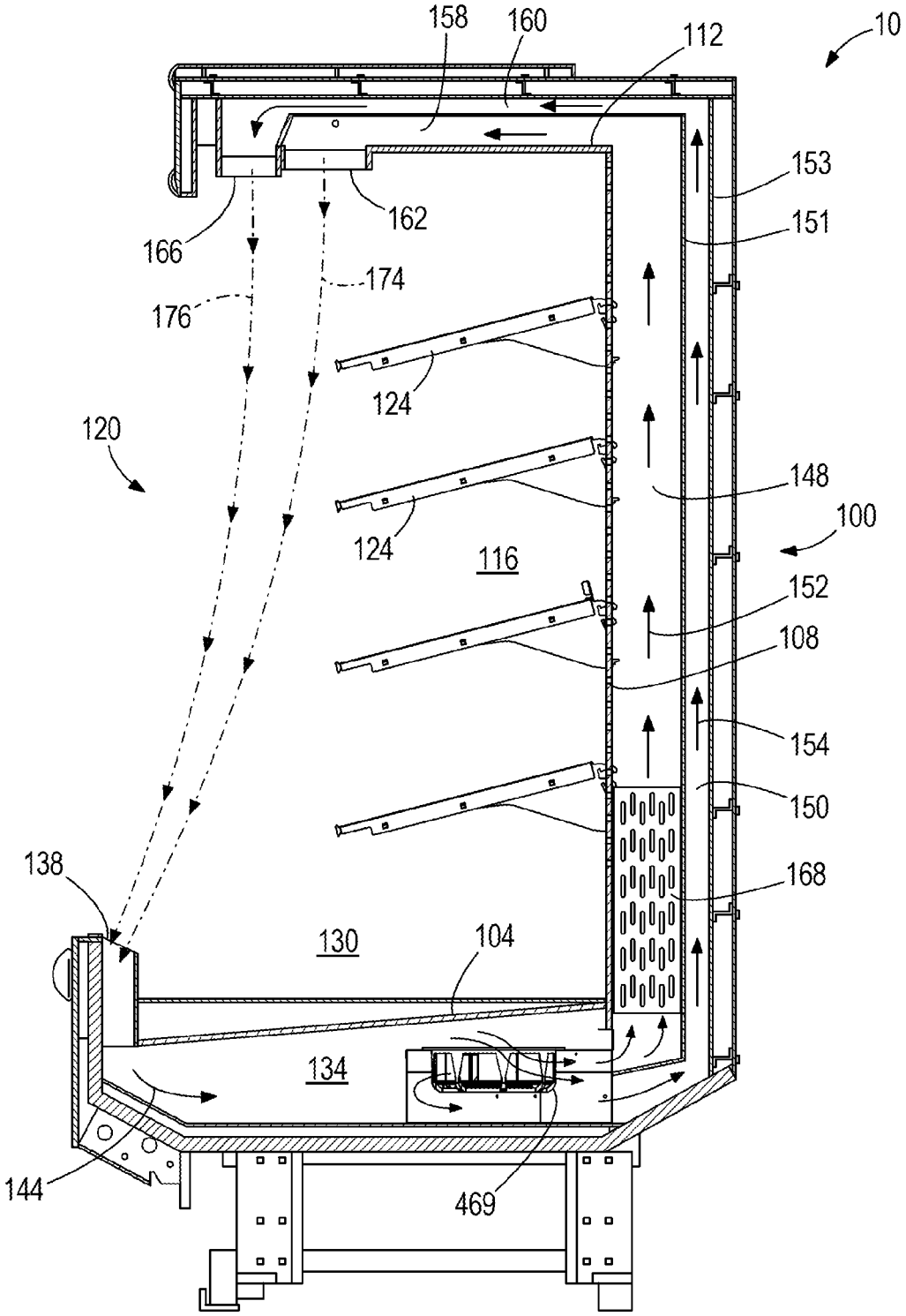
FIG. 9 is a section view of the merchandiser of FIG. 1 including another fan apparatus embodying the invention.

With reference to FIG. 9, the fan apparatus 469 is positioned in the base 104 and is in fluid communication with the lower flue 134. As shown in FIGS. 10-13, the fan apparatus 469 includes a fan assembly 470 and a plenum 472 that generates and divides the airflow 144 into the primary airflow 152 and the secondary airflow 154. As illustrated, the fan assembly 470 and the plenum 472 form a modular assembly. In some constructions, the fan assembly 470 and the plenum 472 can extend the length of the merchandiser 10.

The fan assembly 470 has a fan 500 (e.g., a centrifugal fan) with an inlet 504, an outlet 508, and a hub 512 that is powered by a motor (not shown). The hub 512 supports a plurality of fan blades 516. Support arms 524 form a basket that surrounds the fan blades 516. Each support arm 524 adjoins a flange 530 that couples the fan assembly 470 to the plenum 472.

Figure 10:
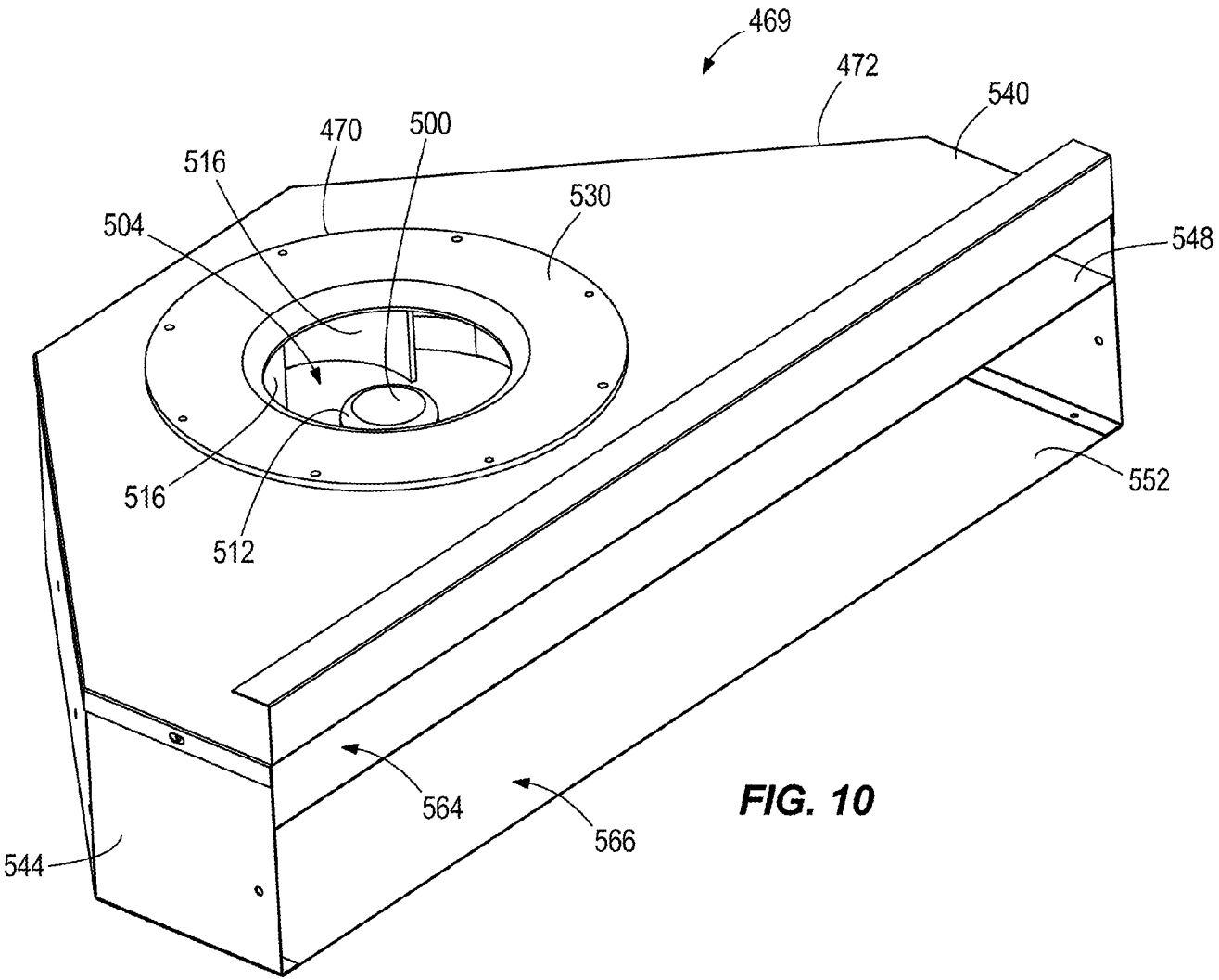
FIG. 10 is a perspective view of the fan apparatus including a fan assembly and a plenum of FIG. 9.
Figure 11:
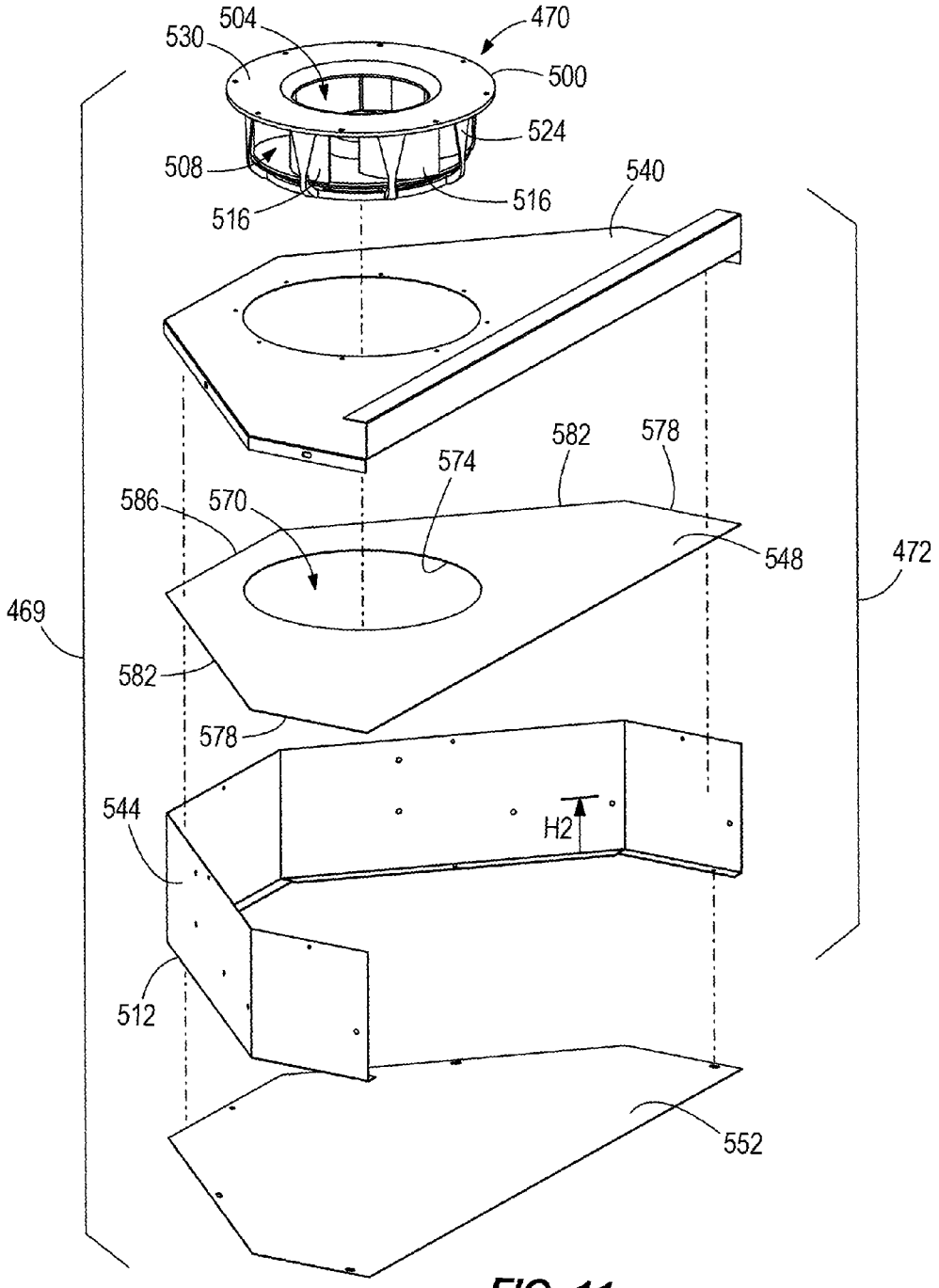
FIG. 11 is an exploded perspective view of the fan apparatus of FIG. 10.
Figure 12:
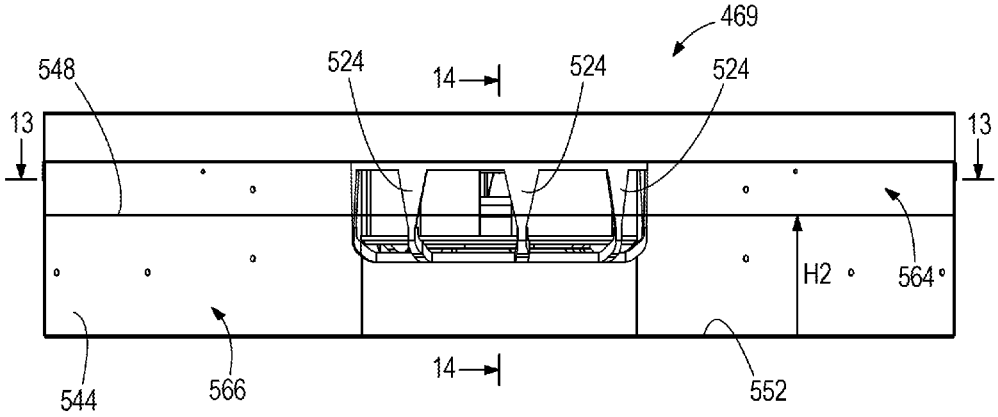
FIG. 12 is a front view of the fan apparatus of FIG. 10.
Figure 13:
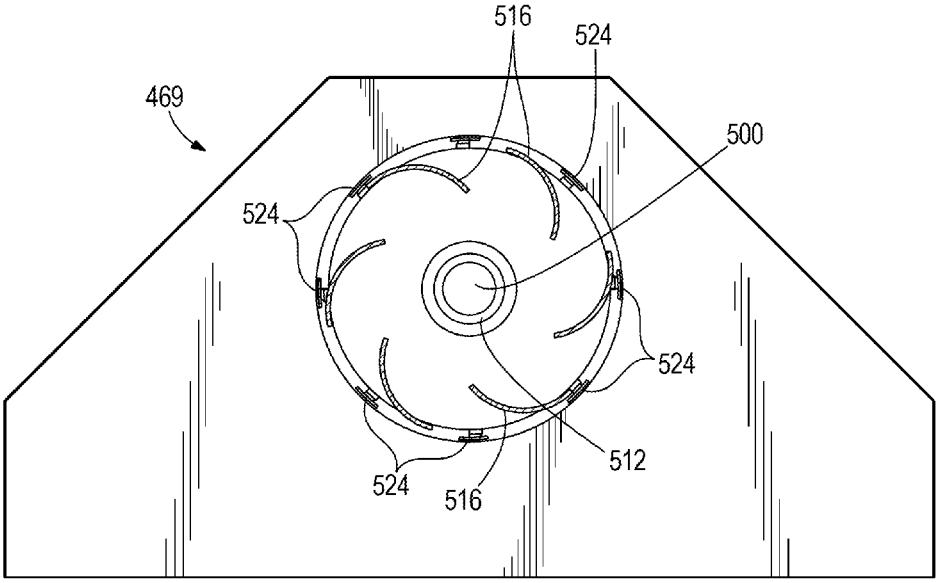
FIG. 13 is a section view of the fan apparatus of FIG. 12 taken along line 13-13.

With reference to FIGS. 10, 12, and 13, the plenum 472 includes a top wall 540, a surrounding multi-sectioned side wall 544, a divider 548, and a base 552 that cooperate to partition the plenum into a primary duct 564 and a secondary duct 566 (see FIG. 10). The top wall is identical to the top wall 240 described with regard to FIG. 3. Likewise, the sidewall 544 is the same as the sidewall 244, and the base 552 is the same as the base 252.

The divider 548 is disposed below and spaced from the top wall 540. The divider 548 spans the entirety of the area partially enclosed by the side wall 544 and includes an opening 570, the perimeter 574 of which uniformly surrounds the support arms 524 adjacent the outlet 508 of the fan 500. The divider 548 is positioned substantially parallel to the top wall 540 and is removably secured at its lateral edges 578, 582 and back edge 586 to the side wall 544 at an intermediate height H2 above the bottom edge 512 of the side wall 544. As described in detail below, this intermediate height H2 can be changed to adjust the quantity of air directed into each of the primary and secondary rear flues 148, 150.

Figure 14:
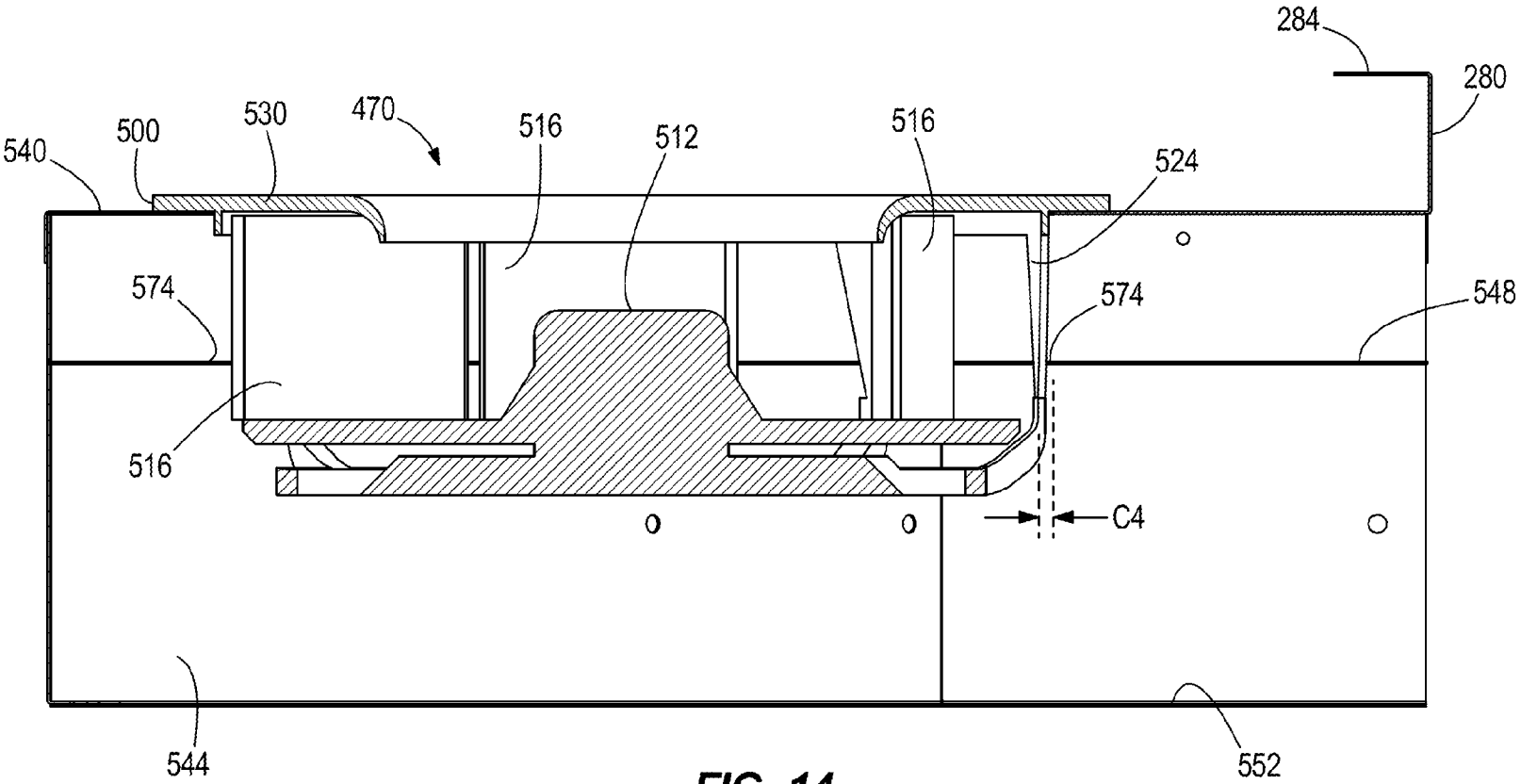
FIG. 14 is a section view of a portion of the fan apparatus of FIG. 12 taken along line 14-14.

FIG. 14 shows the structural relationship between the fan assembly 470 and the divider 548. As illustrated, the divider 548, and more specifically the opening perimeter 574, is positioned so that a clearance C4 exists between the support arms 524 and the perimeter 574. As illustrated, the clearance C4 is approximately 3 millimeters, although other distances for the clearance C4 are also considered herein (e.g., 1 millimeter, 5 millimeters, 20 millimeters, etc.).

Figure 16:
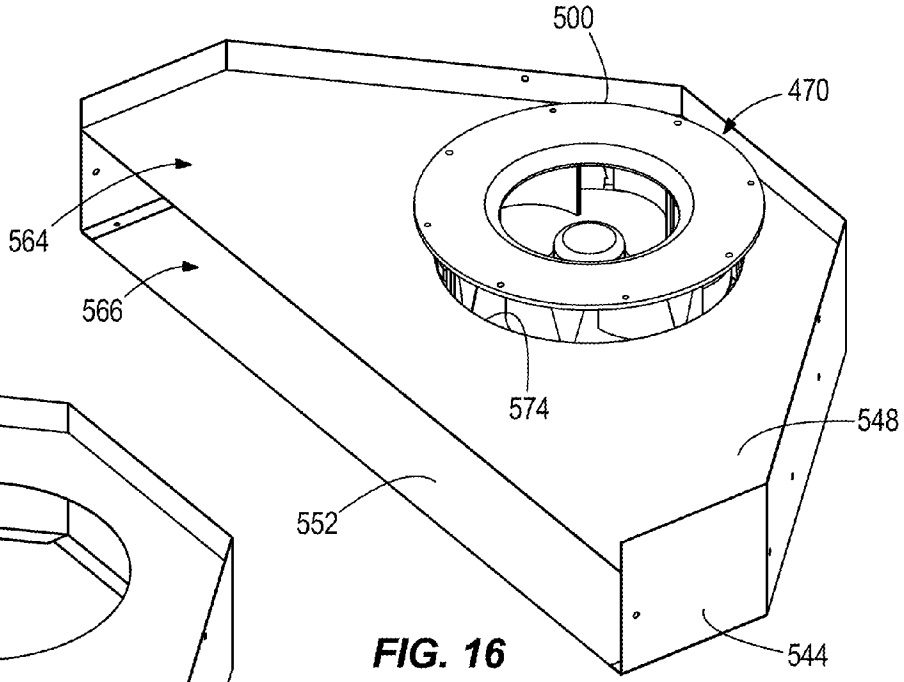
FIG. 16 is a perspective view of a portion of the fan assembly and the plenum of FIG. 10.
Figure 15:
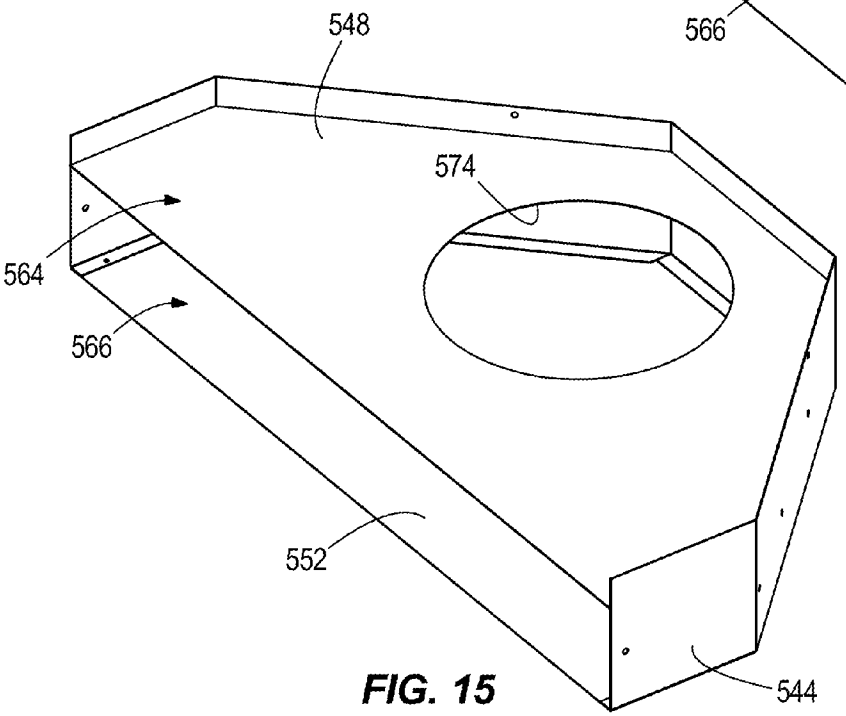
FIG. 15 is a perspective view of a portion of the plenum of FIG. 10.
Figure 17:
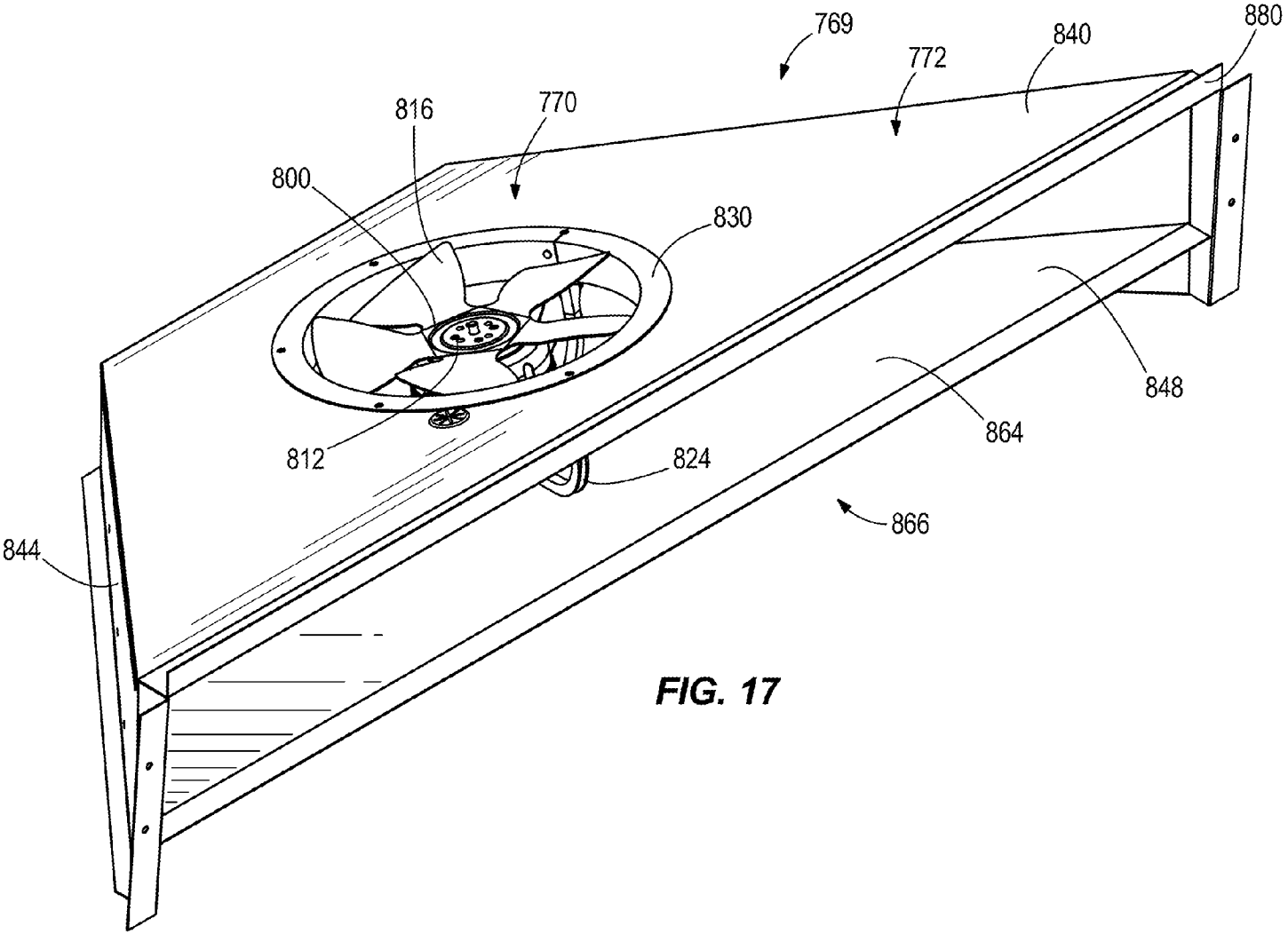
FIG. 17 is a perspective view of another fan apparatus including a fan assembly and a plenum of FIG. 1.

Referring to FIGS. 15 and 16, the primary duct 564 generally defines a volume between the top wall 540 (not illustrated in FIGS. 7 and 8 for clarity), the divider 548, and the side wall 544 that is in fluid communication with the fan outlet 508. The secondary duct 566 generally defines a volume between the divider 548, the base 552, and the side wall 544 that also is in fluid communication with the fan outlet 508.

In some constructions, two separate fan assemblies 470 can be used within a single plenum 472. In these constructions, the discharged airflow of each fan 500 is separated by a divider 548 into the primary and secondary ducts 564, 566. Also, while the divider 548 is illustrated as being integrated into the plenum 472, the divider 548 can instead be integrated into the fan assembly 470. In yet another construction, the fan assembly 470 and plenum 472 can be positioned at the rear of the case 100 or at the top of the case 100 (with modifications made as necessary to the flues 148, 150, 158, 160 and the heat exchanger 190).

FIGS. 17-23 show another fan apparatus 769 for use with the merchandiser 10.

With reference to FIG. 1, the fan apparatus 769 is positioned in the base 104 and is in fluid communication with the lower flue 134. With reference to FIGS. 17-20, the fan apparatus 769 includes a fan assembly 770 and a plenum 772 that generates and divides the airflow 144 into the primary airflow 152 and the secondary airflow 154. As illustrated, the fan assembly 770 and the plenum 772 form a modular assembly. In some constructions, the fan assembly 770 and the plenum 772 can extend the length of the merchandiser 10.

FIGS. 17-20 show the fan assembly 770 and the plenum 772. The fan assembly 770 has a fan 800 (e.g., an axial flow or similarly constructed fan) with an inlet 804, an outlet 808, and a hub 812 that is powered by a motor 814. The hub 812 supports a plurality of fan blades 816. Support arms 824 form a basket that surrounds the motor 814. The support arms 824 adjoin a partial shroud 828 affixed to or formed as part of a flange 830 that couples the fan assembly 770 to the plenum 772.

The plenum 772 includes a top wall 840, a surrounding multi-sectioned side wall 844, a primary duct base 848, and a divider 860 (FIG. 18) that cooperate to partition the plenum into a primary duct 864 and a secondary duct 866. The secondary duct 866 is further defined by a portion of the lower flue 134 (not shown) upon assembly into the merchandiser 10. The plenum 772 can be formed from any suitable material (e.g., sheet metal such as galvanized steel, aluminum, or stainless steel, plastic, etc.).

Figure 18:
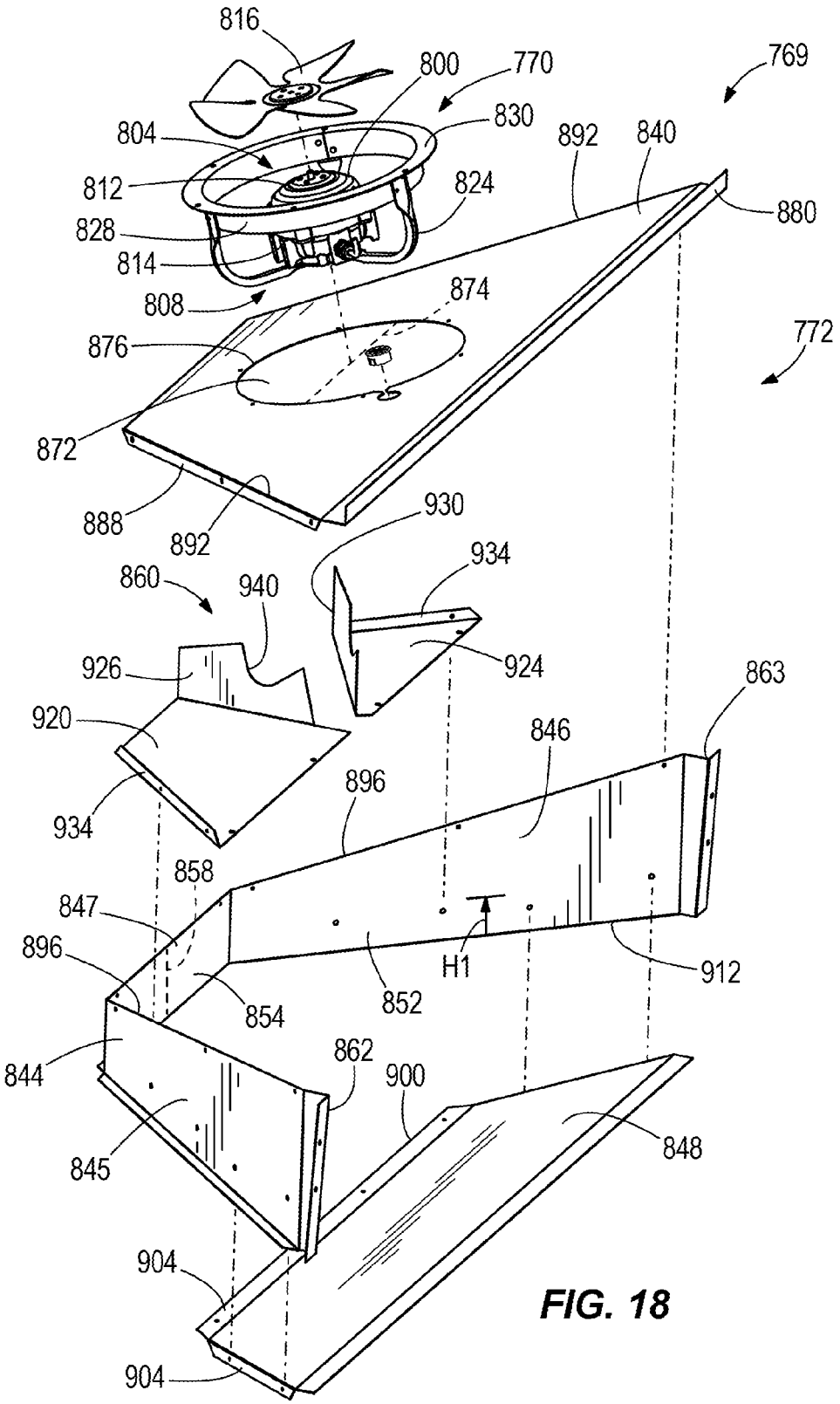
FIG. 18 is an exploded perspective view of the fan apparatus of FIG. 17.

With reference to FIG. 18, the multi-sectioned side wall 844 with includes first and second portions 845, 846, and an intermediate portion 847 between the portions 845, 846. The first portion 845 includes an end 862 and defines a generally planar first face 850 (see FIG. 19), the second portion 846 includes an end 863 and defines a generally planar second face 852, and the intermediate portion 847 defines a generally planar intermediate face 854. A midline 858 can be defined bisecting the intermediate face 854 into two equal parts. Although not illustrated as such, the first and second portions 845, 846 can vary with respect to the intermediate portion 847 in terms of size and angular orientation.

The top wall 840 includes a fan aperture 872 with a centerline 874 and a perimeter 876 to which the fan assembly 770 is secured (e.g., using conventional mounting hardware) via the flange 830. A rim 880 extends upward from and across an edge of the top wall 840. The top wall 840 spans the entirety of the area partially enclosed by the portions 845, 846, 847 and includes tabs 888 at each edge 892 that secure the top wall 840 to the top edge 896 of the first and second portions 845, 846. In other embodiments, the fan aperture 872, and thus the fan 800, is not generally centrally located in the top wall 840 but can be located farther from or closer to any of the side wall portions 845, 846, 847.

The primary duct base 848 is disposed below and spaced from the top wall 840 to accommodate the fan assembly 770. The primary duct base 848 spans an area from the front rim 880 of the top wall 840 rearward to an edge 900 that is approximate the centerline 874 of the fan aperture 872. The primary duct base 848 is positioned substantially parallel to the top wall 840 and includes tabs 904 that removably secure the primary duct base 848 to the side wall 844 at an adjustable intermediate height H1 above a bottom edge 912 of the side wall 844.

Figure 20:
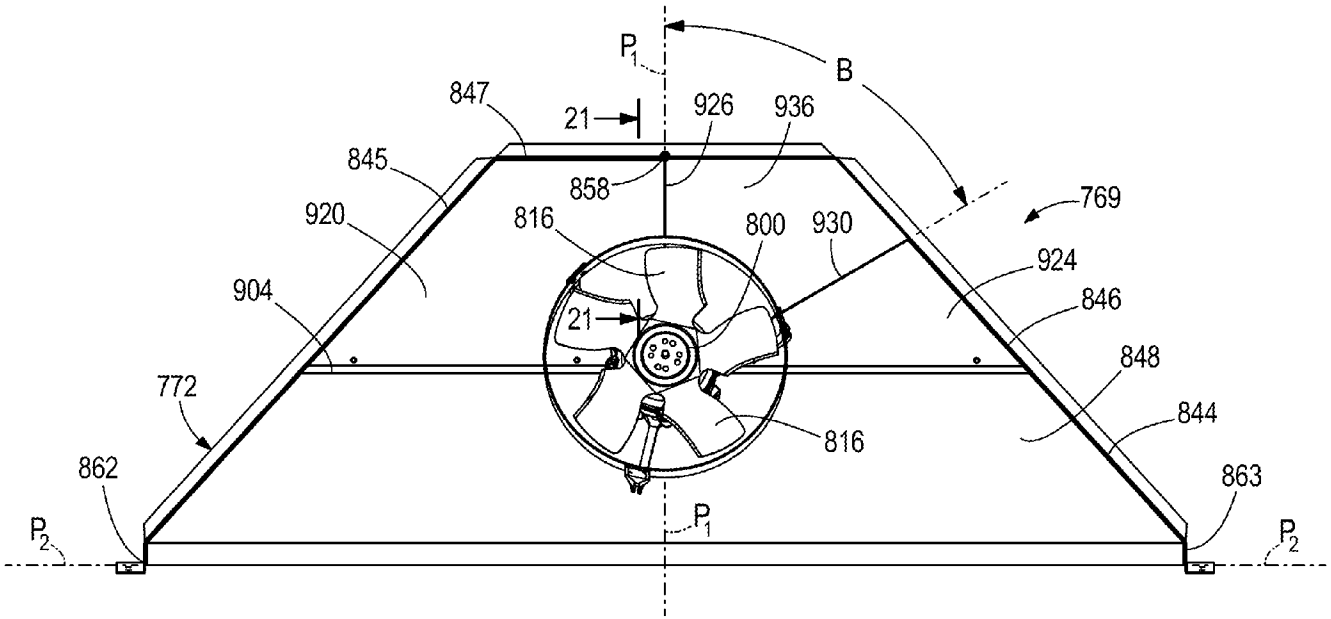
FIG. 20 is a section view of the fan apparatus of FIG. 19 taken along line 20-20.

With continued reference to FIG. 18, the divider 860 includes a first base member 920 and a second base member 924 that support a first wall member 926 and a second wall member 930, respectively. The first and second base members 920, 924 are coupled to the tab 904 near the edge 900 of the primary duct base 848 and are positioned substantially flush with the primary duct base 848 when assembled onto the primary duct base 848. The first and second base members 920, 924 each have tabs 934 that secure the divider 860 to the side wall 844. The first and second wall members 926, 930 operably separate the primary duct 864 from the secondary duct 866 and are, in profile, shaped to conform to the components of the fan assembly 770, as will be further described below. Referring to FIG. 20, the divider wall members 926, 930 are angled apart from each other at an angle β. In the illustrated embodiment, the angle β is approximately 60°. In other constructions, the angle β can range from approximately 30° to approximately 90°.

Figure 19:
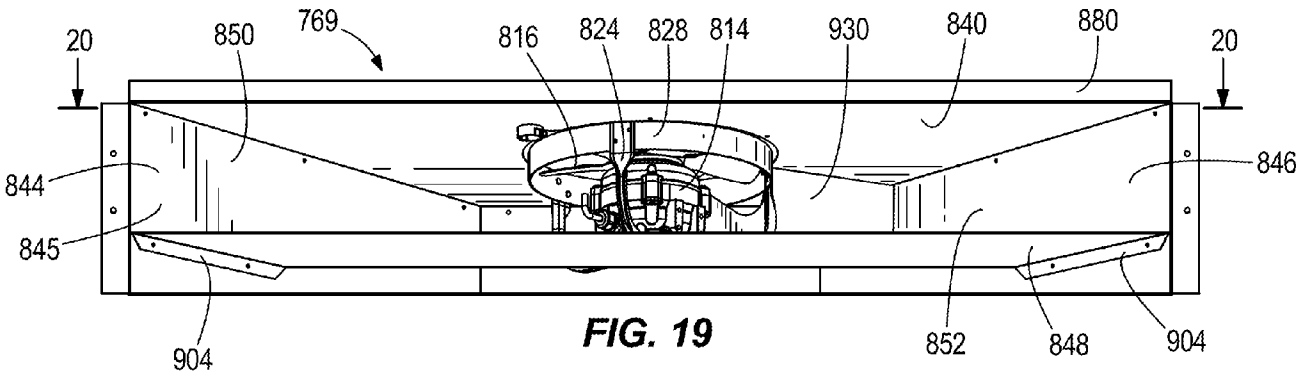
FIG. 19 is a front view of the fan apparatus of FIG. 17.

FIGS. 19 and 20 illustrate the first wall member 926 extending to the intermediate face 854 of the intermediate portion 847 while the second wall member 930 extends to the second face 852 of the second portion 846. In other embodiments, the first base member 920 and first wall member 926 can be shaped or otherwise configured such that the first wall member 926 extends to the first face 850 of the first portion 845 while the second base member 924 and second wall member 930 is shaped or otherwise configured such that the second wall member 930 extends to the intermediate face 854 of the intermediate portion 847. The first and second wall members 926, 930 can extend such that they contact the respective faces 850, 852, 854 or alternatively, can extend to a position adjacent to those faces with a minimal clearance. Though illustrated extending to the midline 858, the wall member 926 (or in another embodiment the wall member 930) extending to the intermediate face 854 can alternatively extend to either side of the midline 858 at or adjacent to the intermediate face.

The space between the first wall member 926 and the second wall member 930 due to the angular separation between the members 926, 930 defines an area 936 when viewed from the perspective of FIG. 20. As illustrated, the entirety of the area 936 exists to a first side of a plane P1 defined through the center of the fan aperture 872 and that is perpendicular to a plane P2 coincident with the ends 862, 863 of the wall 844 defining the outlet of the plenum 772. The plane P1 may or may not be aligned with the midline 858 depending on the positioning of the fan aperture 872. In an alternative embodiment in which the wall member 926 extends to either side of the midline 858, or to the opposing second side of the plane P1, at or adjacent to the intermediate face 854, merely a greater portion of the area 936 exists to the first side of the plane P1 than to the opposing second side of the plane P1.

Figure 21:
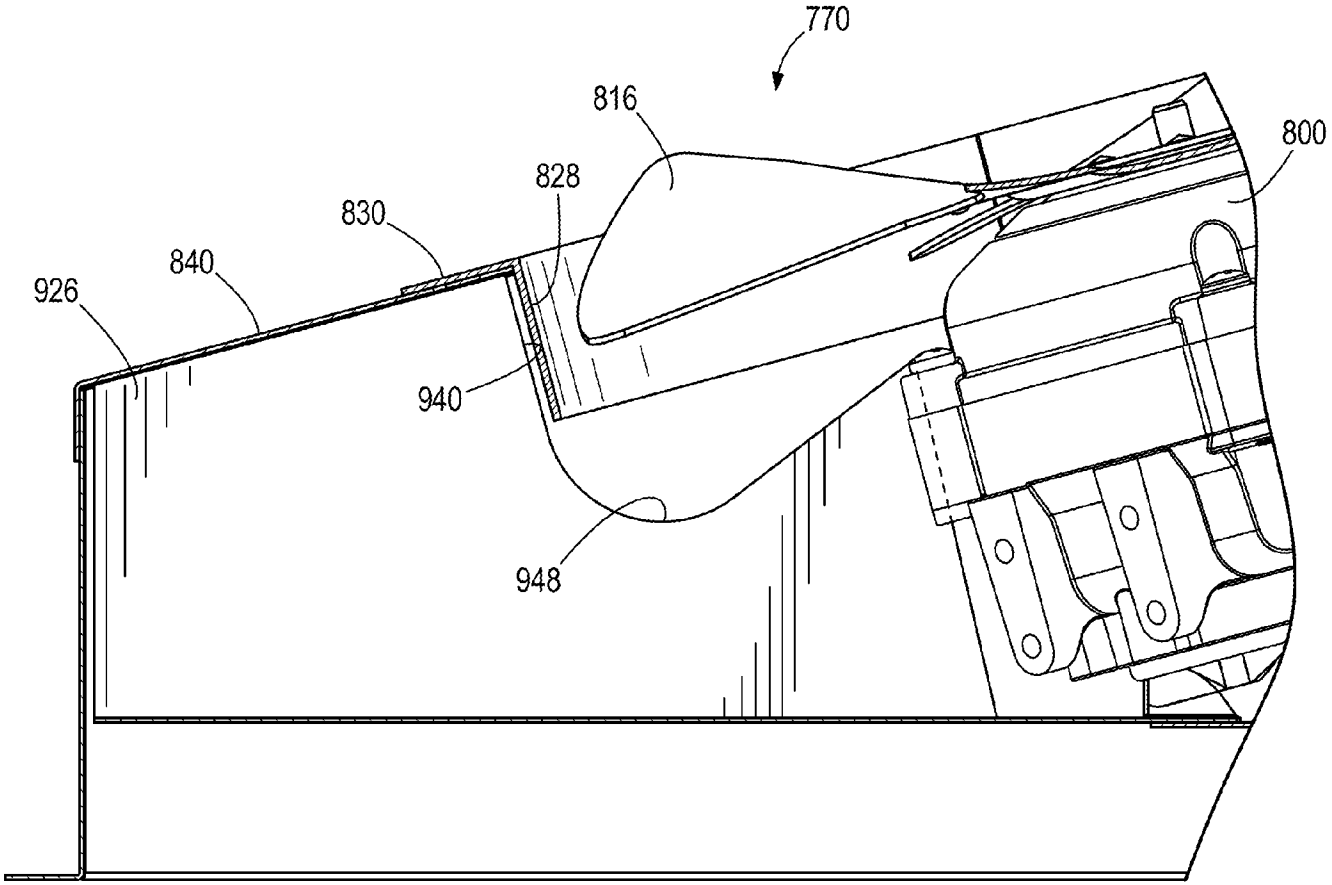
FIG. 21 is a section view of a portion of the fan apparatus of FIG. 20 taken along line 21-21.

FIG. 21 shows the structural relationship between the fan assembly 770 and the first divider wall 926. As illustrated, the divider wall 926 includes a first vertical edge 940 that smoothly and continuously transitions to a second edge 948. The fan assembly 770 is positioned so that the clearance between the fan blades 816 and the edges 940, 948 is at an operational minimum, as an example, no greater than about ⅛" to ¼".

Figure 22:
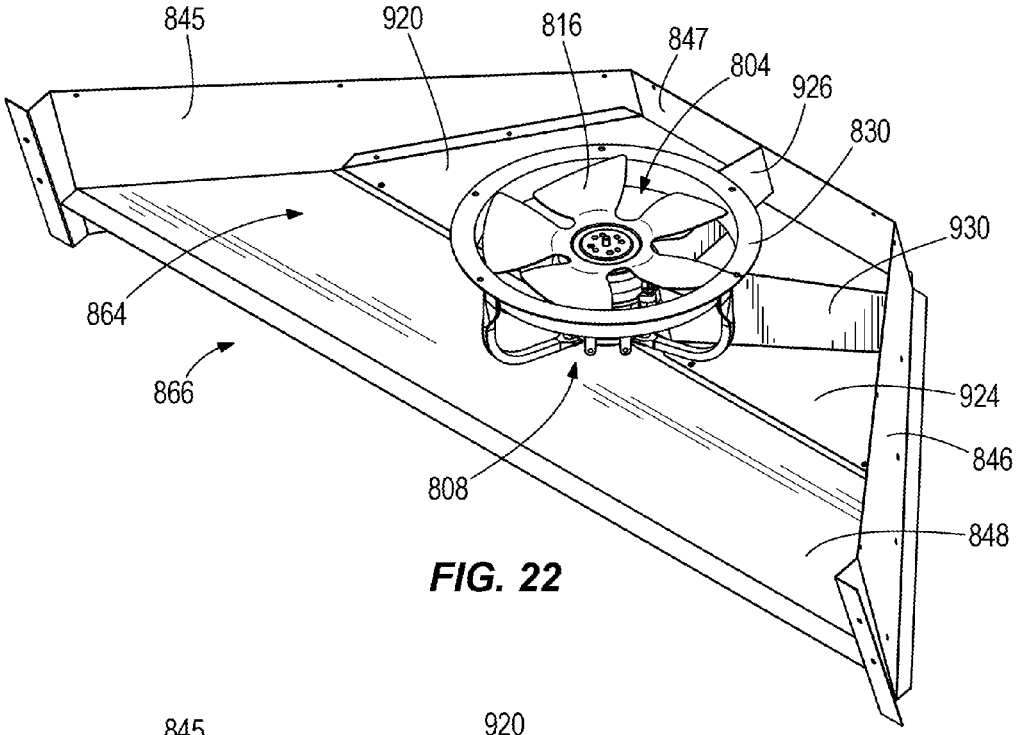
FIG. 22 is a perspective view of a portion of the plenum of FIG. 17.
Figure 23:
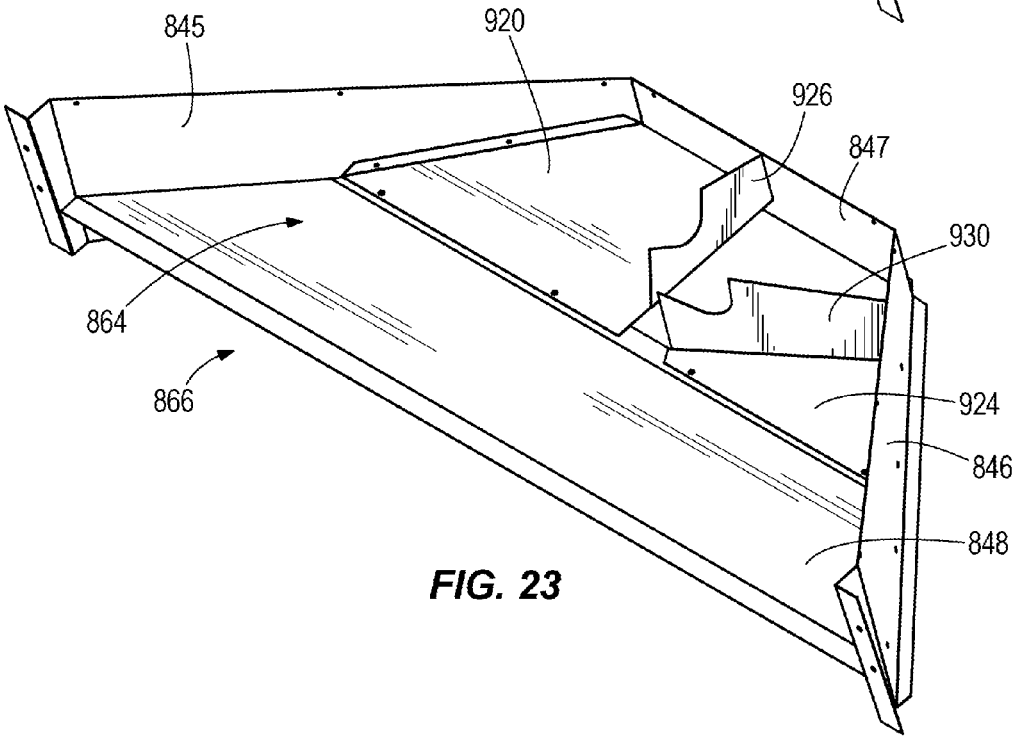
FIG. 23 is a perspective view of a portion of the fan assembly and the plenum of FIG. 17.

Referring to FIGS. 22 and 23, the primary duct 864 generally defines a volume between the top wall 840 (not illustrated in FIGS. 22 and 23 for clarity), the primary duct base 848, the side wall 844, and the first and second divider walls 926, 930 that is in fluid communication with the fan outlet 808. The secondary duct 866 generally defines a volume between the primary duct base 848, a portion of the lower flue 134 (not shown), the side wall 844, and the first and second divider walls 926, 330 that also is in fluid communication with the fan outlet 808.

While the divider 860 is illustrated as being integrated into the plenum 872, the divider 860 can instead be integrated into the fan assembly 870. In yet another construction, the fan assembly 870 and plenum 872 can be positioned at the rear of the case 100 or at the top of the case 100 (with modifications made as necessary to the flues 148, 150, 158, 160 and the heat exchanger 190).

With regard to the fan apparatus 169, in operation, the rotating fan 200 draws the airflow 144 through the lower flue 134 to the fan inlet 204. The plenum 172 and the divider 260 cooperate to split the airflow 144 into the primary airflow 152 and the secondary airflow 154 at the outlet 208. The primary airflow 152 flows through the primary duct 264, the heat exchanger 190, the primary rear flue 148, the primary upper flue 158, and the outlet 162 to form the cooled or refrigerated primary air curtain 174.

The secondary airflow 154 flows through the secondary duct 264, the secondary rear flue 150, the secondary upper flue 160, and the outlet 166, bypassing the heat exchanger 190, to form the secondary air curtain 176. As described, the secondary air curtain 176 buffers the primary air curtain 174 to limit infiltration of ambient air into the product display area 116. At least some air from either or both the primary air curtain 174 and the secondary air curtain 176 is drawn into the lower flue 134 through the inlet 138, which in turn forms the airflow 144.

The fan apparatus 169 can be adjusted or modified based on desired characteristics for the primary airflow 152 and the secondary airflow 154 (e.g., how much air defines each airflow). For example, the distances associated with one or more of the clearances C1, C2, C3 can be adjusted to control the interaction between the primary and secondary airflows 152, 154. If a greater level of interaction is desired (i.e., more mixing of the airflows 152, 154 prior to entry into the ducts 264, 266), the distance of any or all of the clearances C1, C2, C3 can be enlarged. Conversely, if a lower level of interaction is desired, (i.e., more independence between the airflows 152, 154), the distance of any or all of the clearances C1, C2, C3 can be reduced.

Generally, smaller distances for the clearances C1, C2, C3 result in greater independence between the airflows 152, 154 by limiting airflow crossover from one duct to the other. As a result, different static pressures can be maintained in each duct 264, 266. Therefore, a relatively constant air volume can be maintained in one of the primary and secondary ducts 264, 266 regardless of changes to static pressure in the other of the primary and secondary ducts 264, 266. As illustrated, the airflows 152, 154 are substantially independent such that the primary airflow 152 is relatively unaffected by changing air pressures or air volumes of the secondary airflow 154. Likewise, the secondary airflow 154 is relatively unaffected by changing air pressures or air volumes of the primary airflow 152.

The quantity of air discharged as the primary airflow 152 and the secondary airflow 154 is proportional to the angle $\alpha$. As the angle $\alpha$ increases, more air flows to the secondary duct 266 and less air flows to the primary duct 264, increasing the quantity of air defining the secondary airflow 154 (and thus the quantity of air defining the secondary air curtain 176), and decreasing the quantity of air defining the primary airflow 152 (and thus the quantity of air defining the primary air curtain 174). As the angle $\alpha$ decreases, less air flows to the secondary duct 266 and more air flows to the primary duct 264, increasing the quantity of air defining the primary airflow 152 and the primary air curtain 174 and decreasing the quantity of air defining the secondary airflow 154 and the secondary air curtain 176.

The configuration of the plenum 172 with the divider 260 allows a single fan assembly 170 to create two distinct air curtains 174, 176 for maintaining the product display area 116 at desired predetermined conditions. Using one fan rather than two fans reduces component and electrical power costs and simplifies assembly and maintenance of the merchandiser 10.

Except as described below, the fan apparatus 469 including the fan assembly 470 and the plenum 472 described with regard to FIGS. 9-16 operates the same as the fan apparatus 169 described with regard to FIGS. 1-8.

In particular, the fan apparatus 469 can be adjusted or modified based on desired characteristics for the primary airflow 152 and the secondary airflow 154 (e.g., how much air defines each airflow). For example, the distance associated with the clearance C4 can be adjusted to control the interaction between the primary and secondary airflows 152, 154. If a greater level of interaction is desired (i.e., more mixing of the airflows 152, 154 prior to entry into the ducts 564, 566), the dimension of the clearance C4 can be enlarged. Conversely, if a lower level of interaction is desired, (i.e., more independence between the airflows 152, 154), the dimension of the clearance C4 can be reduced.

Generally, a smaller dimension for the clearance C4 results in greater independence between the airflows 152, 154 by limiting airflow crossover from one duct to the other. As a result, different static pressures can be maintained in each duct 564, 566. Therefore, a relatively constant air volume can be maintained in one of the primary and secondary ducts 564, 566 regardless of changes to static pressure in the other of the primary and secondary ducts 564, 566. As illustrated, the airflows 152, 154 are substantially independent such that the primary airflow 152 is relatively unaffected by changing air pressures or air volumes of the airflow 154. Likewise, the secondary airflow 154 is relatively unaffected by changing air pressures or air volumes of the primary airflow 152.

The quantity of air discharged as the primary airflow 152 and the secondary airflow 154 is proportional to the vertical position of the divider 548 within the plenum 472 (i.e., the height H2). As the dimension of the height H2 increases, more air flows to the enlarged secondary duct 566 and less air flows to the reduced primary duct 564, which in turn affects the amount of air defining the primary and secondary air curtains 174, 176. Specifically, the enlarged secondary duct 566 increases the quantity of air defining the secondary air curtain 176 and the reduced primary duct 564 decreases the quantity of air defining the primary air curtain 174. Conversely, as the height H2 decreases, less air flows to the reduced secondary duct 566 and more air flows to the enlarged primary duct 564, increasing the quantity of air defining the primary air curtain 174 and decreasing the quantity of air defining the secondary air curtain 176.

The fan apparatus 769 including the fan assembly 770 and the plenum 772 described with regard to FIGS. 17-23 operates similarly to the fan apparatus 169 described with regard to FIGS. 1-8.

In operation, the rotating fan 800 draws the airflow 144 through the lower flue 134 to the fan inlet 804. The plenum 772 and the divider 860 cooperate to split the airflow 144 into the primary airflow 152 and the secondary airflow 154 at the outlet 808. The primary airflow 152 flows through the primary duct 864, the heat exchanger 190, the primary rear flue 148, the primary upper flue 158, and the outlet 162 to form the cooled or refrigerated primary air curtain 174.

The secondary airflow 154 flows through the secondary duct 864, the secondary rear flue 150, the secondary upper flue 160, and the outlet 166, bypassing the heat exchanger 190, to form the secondary air curtain 176, as previously described.

The fan apparatus 769 can be adjusted or modified based on desired characteristics for the primary airflow 152 and the secondary airflow 154 (e.g., how much air defines each airflow). For example, the clearance between the fan blades 816 and the edges 940, 948 can be adjusted to control the interaction between the primary and secondary airflows 152, 154. If a greater level of interaction is desired (i.e., more mixing of the airflows 152, 154 prior to entry into the ducts 864, 866), this clearance can be enlarged. Conversely, if a lower level of interaction is desired, (i.e., more independence between the airflows 152, 154), the clearance can be reduced.

Generally, a smaller clearance results in greater independence between the airflows 152, 154 by limiting airflow crossover from one duct to the other. As a result, different static pressures can be maintained in each duct 864, 866. Therefore, a relatively constant air volume can be maintained in one of the primary and secondary ducts 864, 866 regardless of changes to static pressure in the other of the primary and secondary ducts 864, 866. As illustrated, the airflows 152, 154 are substantially independent such that the primary airflow 152 is relatively unaffected by changing air pressures or air volumes of the secondary airflow 154. Likewise, the secondary airflow 154 is relatively unaffected by changing air pressures or air volumes of the primary airflow 152.

The quantity of air discharged as the primary airflow 152 and the secondary airflow 154 is proportional to the angle β. As the angle β increases, more air flows to the secondary duct 866 and less air flows to the primary duct 864, increasing the quantity of air defining the secondary airflow 154 (and thus the quantity of air defining the secondary air curtain 176), and decreasing the quantity of air defining the primary airflow 152 (and thus the quantity of air defining the primary air curtain 174). As the angle β decreases, less air flows to the secondary duct 866 and more air flows to the primary duct 864, increasing the quantity of air defining the primary airflow 152 and the primary air curtain 174 and decreasing the quantity of air defining the secondary airflow 154 and the secondary air curtain 176.

It has been determined that, due to the rotation of the fan 800, the velocity of the primary airflow 152 is not uniform across the heat exchanger 190 when the divider 860 is symmetric with respect to the fan 800 and the side wall 844 (i.e., if the wall members 926, 930 as assembled have an identical spatial relationship to the midline 858 of the intermediate face 854). In other words, the specific orientation of the first and second wall members 926, 930 with respect to the side wall 844 affects the velocity distribution of the primary airflow 152. As a result of modifying the orientation between the first and second wall members 926, 930 and the first and second portions 845, 846, the flow characteristics of the primary airflow 152 can be manipulated to produce a more uniform primary airflow velocity across the face of the heat exchanger 190 depending on the desired operational speed and rotational direction of the fan 800. A more uniform primary airflow velocity improves the overall heat transfer of the heat exchanger 190 and consistency of temperature and coverage of the primary air curtain 174.

For example, with a counterclockwise rotation of the fan 800, orientation of the divider 860 as illustrated in FIGS. 17-23 such that the first wall 926 extends to the intermediate face 854 of the intermediate portion 847 while the second wall 930 extends to the second face 854 of the second portion 846 "shifts" the area 936 to one side of the plane P1, which tends to even out the primary airflow 152 across the face of the heat exchanger 190. Likewise, orientation of the divider 860 such that the first wall 926 extends to the first face 850 of the first portion 845 while the second wall 930 extends to the intermediate face 854 (not shown) shifts the area 936 to the other side of the plane P1, which will tend to even out the primary airflow 152 for clockwise operation of the fan 800. The precise positioning of the divider 860 can be configured to account for the specific parameters of the fan 800 to offset the effects of fan rotation, as well as for varying the flow to the primary and secondary ducts 864, 866, as previously described.

Various features and advantages of the invention are set forth in the following claims.

The invention claimed is:

1. A refrigerated merchandiser comprising:

a case defining a product display area and including a base, a lower flue, a first air passageway, and a second air passageway, the first air passageway and second air passageway in fluid communication with the lower flue and with the product display area;

an evaporator positioned in the first air passageway;

a fan assembly positioned in the base in fluid communication with the lower flue to generate an airflow; and a fan plenum into which the fan assembly is disposed, the fan plenum including a wall having a first portion with a first face, a second portion with a second face, and an intermediate portion connecting the first portion to the second portion and having an intermediate face, and an airflow divider to direct a first portion of the airflow to the first air passageway and to direct a second portion of the airflow to the second air passageway, the airflow divider including a first wall member extending to the first face and a second wall member extending to the intermediate face, wherein the proportion of air between the first portion and the second portion is a function of the position and geometry of the airflow divider.

2. The refrigerated merchandiser of claim 1, wherein the fan assembly includes a fan having a plurality of fan blades, wherein the airflow divider and the plurality of fan blades define a clearance therebetween, and wherein interaction between the first portion and the second portion of the airflow is dependent on the clearance.

3. The refrigerated merchandiser of claim 1, wherein the fan assembly includes an axial flow fan.

4. The refrigerated merchandiser of claim 1, wherein the fan plenum includes a top wall secured to the first portion and to the second portion, and wherein the airflow divider partitions the fan plenum into a first duct and a second duct, the first duct in communication with the first air passageway and the second duct in communication with the second air passageway.

5. The refrigerated merchandiser of claim 4, wherein the top wall includes a fan aperture for receiving a fan having a plurality of fan blades, and wherein the fan aperture is equidistant from the first portion of the wall and the second portion of the wall.

6. The refrigerated merchandiser of claim 4, wherein the first wall member and the second wall member are orthogonal to the top wall.

7. The refrigerated merchandiser of claim 6, wherein an angular separation β of the first wall member from the second wall member ranges from about 30° to about 90°, whereby the quantity of air discharged to the first passageway with respect to the second passageway is proportional to β.

8. The refrigerated merchandiser of claim 7, wherein the angular separation of the first wall member from the second wall member is 60°.

9. A refrigerated merchandiser comprising:

a case defining a product display area and including a base, a lower flue, a first air passageway, and a second air passageway, the first air passageway and second air passageway in fluid communication with the lower flue and with the product display area;

an evaporator positioned in the first air passageway;

a fan assembly positioned in the base in fluid communication with the lower flue to generate an airflow; and a fan plenum with a fan aperture into which the fan assembly is disposed, the fan aperture having a center, the fan plenum having an outlet defining a first plane, wherein a second plane is defined perpendicular to the first plane and passing through the center of the fan aperture, the fan plenum further including an airflow divider with a first wall member and a second wall member positioned to direct a first portion of the airflow through the outlet to the first air passageway and to direct a second portion of the airflow through the outlet to the second air passageway, and wherein the space between the first wall member and the second wall member defines an area, the greater portion of which is to one side of the second plane.

10. The refrigerated merchandiser of claim 9, wherein the fan assembly includes a fan having a plurality of fan blades, wherein the airflow divider and the plurality of fan blades define a clearance therebetween, and wherein interaction between the first portion and the second portion of the airflow is dependent on the clearance.

11. The refrigerated merchandiser of claim 9, wherein the fan assembly includes an axial flow fan.

12. The refrigerated merchandiser of claim 9, wherein the fan plenum further includes a side wall having first and second ends, and wherein the first plane is coincident with the first and second ends.

13. The refrigerated merchandiser of claim 12, wherein the fan plenum includes a top wall secured to the side wall, and wherein the airflow divider partitions the fan plenum into a first duct and a second duct, the first duct in communication with the first air passageway and the second duct in communication with the second air passageway.

14. The refrigerated merchandiser of claim 12, wherein the center of the fan aperture is equidistant from the first and second ends of the side wall.

15. The refrigerated merchandiser of claim 9, wherein an angular separation β of the first wall member from the second wall member ranges from about 30° to about 90°, whereby the quantity of air discharged to the first passageway with respect to the second passageway is proportional to β.

16. The refrigerated merchandiser of claim 9, wherein the fan plenum further includes a side wall having a first portion with a first face, a second portion with a second face, and an intermediate portion connecting the first portion to the second portion and having an intermediate face, and wherein the first wall member extends to the first face and the second wall member extends to the intermediate face.

17. The refrigerated merchandiser of claim 16, wherein the intermediate face is bisected by a midline, and further wherein the second wall member extends to the midline.

18. A fan plenum for a refrigerated merchandiser, the refrigerated merchandiser including a case defining a product display area and including a lower flue, a first air passageway, and a second air passageway, the first air passageway and second air passageway in fluid communication with the lower flue and with the product display area, the fan plenum comprising:

a top wall including a fan aperture for receiving a fan having a plurality of fan blades, the fan aperture having a center;

an outlet defining a first plane, wherein a second plane is defined perpendicular to the first plane and passing through the center of the fan aperture; and an airflow divider with a first wall member and a second wall member positioned to direct a first portion of the airflow through the outlet to the first air passageway and to direct a second portion of the airflow through the outlet to the second air passageway, and wherein the space between the first wall member and the second wall member defines an area, the greater portion of which is to one side of the second plane.

19. The fan plenum of claim 18, wherein an angular separation β of the first wall member from the second wall member ranges from about 30° to about 90°, whereby the quantity of air discharged to the first passageway with respect to the second passageway is proportional to β.

20. The refrigerated merchandiser of claim 18, wherein the fan plenum further includes a side wall having first and second ends, and wherein the first plane is coincident with the first and second ends.

* * * * *